US009452308B2

(12) United States Patent
Lentz et al.

(10) Patent No.: US 9,452,308 B2
(45) Date of Patent: Sep. 27, 2016

(54) EXERCISE DEVICE

(71) Applicants: Ryan A. Lentz, Colorado Springs, CO (US); Justin M. Gauvin, Waltham, MA (US); Kurin V. Tu, San Mateo, CA (US); Zachary M. Goldberg-Poch, San Francisco, CA (US); Ian Coats MacColl, Mill Valley, CA (US); Alden Morris Mills, Barcelona (ES)

(72) Inventors: Ryan A. Lentz, Colorado Springs, CO (US); Justin M. Gauvin, Waltham, MA (US); Kurin V. Tu, San Mateo, CA (US); Zachary M. Goldberg-Poch, San Francisco, CA (US); Ian Coats MacColl, Mill Valley, CA (US); Alden Morris Mills, Barcelona (ES)

(73) Assignee: Naturally Elevated Xtreme Training, LLC, Colorado Springs, CO (US)

( * ) Notice: Subject to any disclaimer, the term of this patent is extended or adjusted under 35 U.S.C. 154(b) by 0 days.

(21) Appl. No.: 14/530,725

(22) Filed: Nov. 1, 2014

(65) Prior Publication Data

US 2015/0148197 A1 May 28, 2015

Related U.S. Application Data

(60) Provisional application No. 61/902,925, filed on Nov. 12, 2013, provisional application No. 61/948,918, filed on Mar. 6, 2014.

(51) Int. Cl.

| | |
|---|---|
| ***A63B 1/00*** | (2006.01) |
| ***A63B 3/00*** | (2006.01) |
| ***A63B 21/068*** | (2006.01) |
| *A63B 21/16* | (2006.01) |
| *A63B 23/12* | (2006.01) |

(52) U.S. Cl.

CPC ..... *A63B 1/00* (2013.01); *A63B 21/1618* (2013.01); *A63B 3/00* (2013.01); *A63B 21/068* (2013.01); *A63B 21/1627* (2013.01); *A63B 21/1636* (2013.01); *A63B 21/4047* (2015.10); *A63B 23/1218* (2013.01); *A63B 2225/09* (2013.01); *A63B 2225/093* (2013.01)

(58) Field of Classification Search

CPC ..... A63B 1/00; A63B 3/00; A63B 17/00; A63B 17/02; A63B 17/04; A63B 21/068; A63B 21/1618; A63B 21/1627; A63B 21/1636; A63B 21/1645; A63B 21/1654; A63B 21/1663; A63B 21/4033; A63B 21/4035; A63B 21/4047; A63B 22/0046; A63B 22/0048; A63B 23/1218; A63B 2208/0285; A63B 2208/029; A63B 2210/50; A63B 2225/09; A63B 2225/093

See application file for complete search history.

(56) References Cited

U.S. PATENT DOCUMENTS 3,716,232 A * 2/1973 Johnson ..... A63B 1/005 482/40

4,529,191 A * 7/1985 Miller ..... A63B 1/00 211/123

(Continued)

*Primary Examiner* — Oren Ginsberg

*Assistant Examiner* — Joshua Lee

(74) *Attorney, Agent, or Firm* — Matthew J. Lattig; Charter IP, LLC

(57) ABSTRACT

An exercise device for performing a variety of exercises in both doorway-mounted and floor-mounted configurations is described. The device includes a horizontal bar configured for engagement with a doorframe, a pair of support arms, each having one end attached to the horizontal bar and the other end extending through a doorway, and a pivot bar connected between the support arms. The device further includes a pair of pivot arms configured to be rotated about the pivot bar at their first ends so as to be oriented and secured in a plurality of different angular positions relative to the support arms, and a pull-up bar including at least one grip handle configured to be rotated about the pivot arms at their second ends so as to be oriented and secured in a plurality of different angular positions relative to the pivot arms.

18 Claims, 26 Drawing Sheets

(56) References Cited

U.S. PATENT DOCUMENTS

| | | | | |
|---|---|---|---|---|
| 4,844,448 | A * | 7/1989 | Niznik | A63B 21/04 482/129 |
| D348,706 | S | 7/1994 | Harrell | |
| 5,417,628 | A | 5/1995 | Vanderbleek | |
| 6,508,743 | B1 * | 1/2003 | Fortin | A63B 1/00 482/38 |
| D633,961 | S * | 3/2011 | Loew | D21/679 |
| D686,286 | S | 7/2013 | Orakwusi | |
| 8,535,204 | B2 * | 9/2013 | Stacey | A63B 1/00 482/40 |
| 8,622,875 | B2 * | 1/2014 | Ho | A63B 3/00 482/40 |
| 2011/0251027 | A1 * | 10/2011 | Bono | A63B 21/00047 482/93 |
| 2011/0251028 | A1 * | 10/2011 | Bono | A63B 21/00058 482/93 |
| 2012/0094808 | A1 | 4/2012 | Leier | |
| 2012/0115684 | A1 | 5/2012 | Nguyen | |
| 2013/0225373 | A1 * | 8/2013 | Poat | A63B 21/1636 482/40 |
| 2014/0302968 | A1 * | 10/2014 | Velikin | A63B 1/00 482/40 |

* cited by examiner

EXERCISE DEVICE

CROSS-REFERENCE TO RELATED APPLICATION

The present application claims the benefit under 35 U.S.C. §119(e) of U.S. Provisional Patent Application No. 61/902,925 to Justin M. Gauvin, et al., filed Nov. 12, 2013, and of U.S. Provisional Patent Application No. 61/948,918 to Justin M. Gauvin, et al., filed Mar. 6, 2014. The entire contents of each application are hereby incorporated by reference herein.

BACKGROUND

1. Field

The example embodiments in general are directed to an exercise device, more particularly to an exercise device adjustable into a variety of positions for performing a multitude of different exercises.

2. Related Art

Exercise devices are widely marketed. Examples include exercise devices for performing pull-ups, chin-ups, dips, push-ups, rows, sit-ups, crunches, and leg-raises. In order to perform all of these exercises, one would typically need to acquire numerous, disparate exercise devices. The space for using and storing these disparate devices may be prohibitive for users in smaller homes and apartments. Additionally, the cost of purchasing such devices can make staying fit overly expensive.

Due in part to the difficulties in acquiring and owning sufficient home exercise equipment, many consumers turn to commercial gyms in order to improve and maintain their fitness. However, the monthly fees of a gym membership often add-up to a significant amount of money over the course of several years. There is, therefore, a long-standing yet unmet need for exercise equipment allowing those who desire to improve and maintain their fitness to do so from the home, without the need for numerous, costly or bulky exercise devices.

Of the exercise devices presently marketed for a primary purpose of performing pull-ups and chin-ups, or rows and dips, whether free-standing, doorway-mounted, or wall-mounted, only a single height is possible for performing these exercises. The result of a single-height exercise device is that taller users must maintain their legs raised off the ground surface through the bottom portion of the exercise. This is not an ideal form to execute such exercises, nor is it convenient to the user. Additionally, shorter users may have trouble reaching the grips and getting into position on single-height exercise devices. Accordingly, there remains a long-standing need for home exercise equipment which is both height-adjustable and affordable.

SUMMARY

An example embodiment of the present invention is directed to an exercise device configured to be secured within a doorway for performing exercises and configured for use on a ground surface to perform exercises. The device includes an elongate, horizontal bar configured for engagement with a top surface of horizontal doorframe trim extending along a rear facing wall directly above the doorway, a pair of support arms in parallel spaced relation to one other, each support arm having a first end attached to a respective end of the horizontal bar and extending downward therefrom so that second ends of the support arms extend forward of the horizontal bar through the doorway, and an elongate pivot bar extending through apertures in the second ends of the support arms so as to be perpendicular to the support arms, the pivot bar having a telescoping bar portion inserted in each end thereof which is retractable into and extensible out of its respective pivot bar end, each telescoping bar portion engageable with front-facing, vertical door trim on each side of the doorway to assist in securing the exercise device in the doorway with the horizontal bar. The device further includes a pair of pivot arms in parallel spaced relation to one other and having first ends with apertures therein through which the pivot bar extends in perpendicular relation thereto, a first end of each pivot arm adjacent a corresponding second end of a support arm on the pivot bar, the pivot arms configured to be rotated about the pivot bar at their first ends so as to be oriented and secured in a plurality of different angular positions relative to the support arms. Each pivot arm terminates in a second end having an aperture therein through which an elongate pull-up bar extends between in perpendicular relation thereto.

Another example embodiment is directed to an exercise device which includes an elongate, horizontal bar configured for engagement with doorframe trim extending along a rear facing wall above a doorway, a pair of elongate support arms, each having one end attached to the horizontal bar and extending downward therefrom to its lower end, and an elongate pivot bar connected between the support arms, the pivot bar including a telescoping bar portion inserted into each end thereof which is retractable into and extensible out of its respective pivot bar end, each telescoping bar portion engageable with front-facing, vertical door trim on each side of the doorway to assist in securing the exercise device in the doorway with the horizontal bar. The device further includes a pair of pivot arms, each pivot arm having one end through which an end of the pivot bar extends, the one end adjacent a corresponding lower end of a support arm, the pivot arms configured to be rotated about the pivot bar at their one ends so as to be oriented and secured in a plurality of different angular positions relative to the support arms, and an elongate pull-up bar extending between the other ends of the pivot arms.

Another example embodiment is directed to an exercise device which includes a horizontal bar configured for engagement with doorframe trim extending along a rear facing wall above a doorway, a pair of support arms, each having one end attached to the horizontal bar and the other end extending through the doorway, and a pivot bar connected between the support arms. The device further includes a pair of pivot arms, the pivot bar also connected between the pivot arms at first ends thereof, the pivot arms configured to be rotated about the pivot bar at their first ends so as to be oriented and secured in a plurality of different angular positions relative to the support arms, and a pull-up bar extending between second ends of the pivot arms and including grip handles attached thereto, the pull-up bar configured to be rotated about the pivot arms at their second ends so that the grips handles are oriented and secured in a plurality of different angular positions relative to the pivot arms.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As used herein, the term "doorway" refers to the opening in a wall or solid structure, and the term "doorframe" refers to the frame about a doorway including jambs, lintel, sills and any edging or molding around the doorway, for example. As used herein, the term "tubular" includes a hollow rounded cross-section, where a rounded cross-section may be circular, elliptical, and obround cross-sections, for example.

Figure 1:
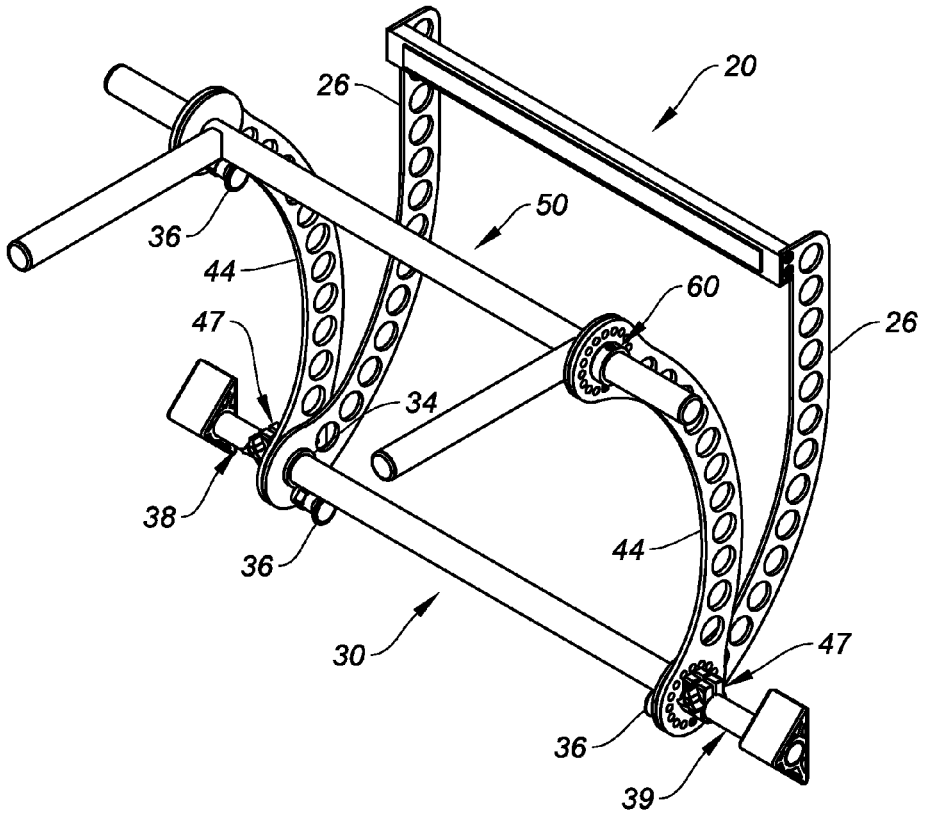
FIG. 1 is an isometric view of an exercise device according to an example embodiment with the arms in an upper position.
Figure 2:
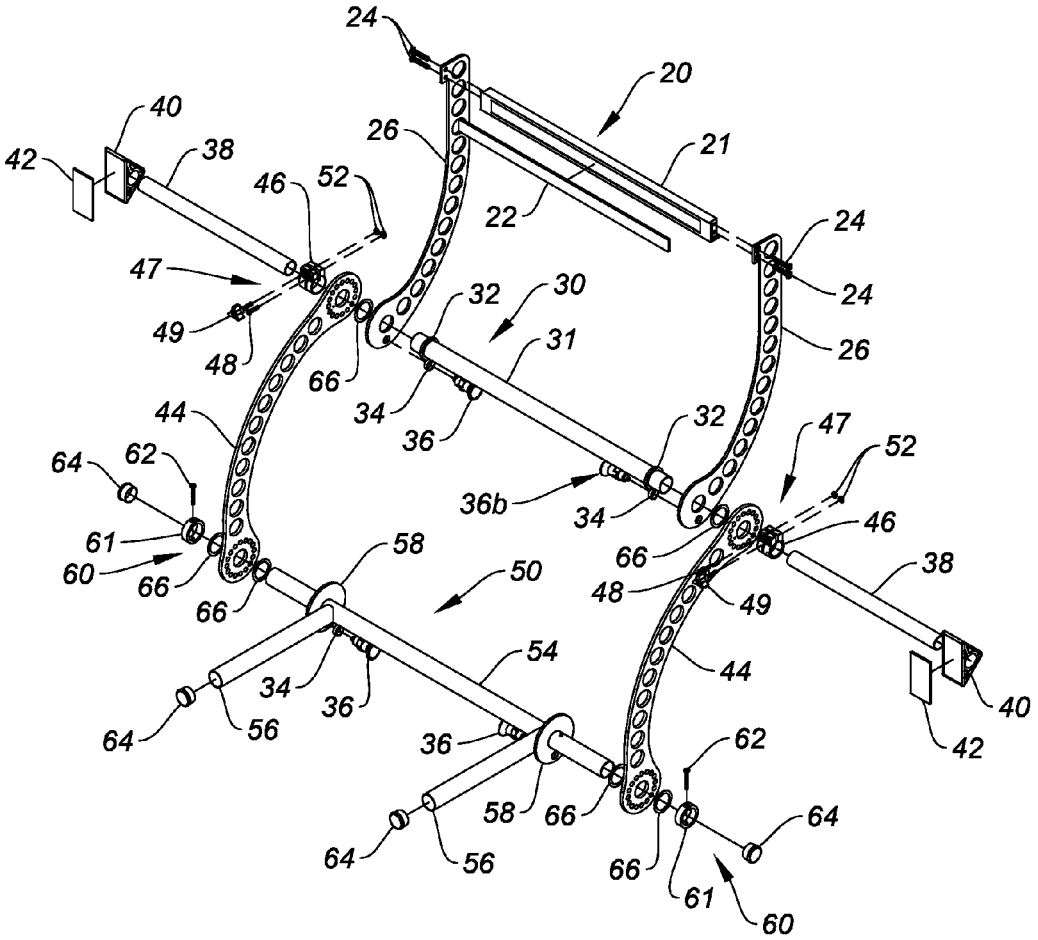
FIG. 2 is an isometric, exploded parts view of the exercise device with the arms in a lower position.

FIG. 1 is an isometric view of an exercise device according to an example embodiment with the arms in an upper position; and FIG. 2 is an isometric, exploded parts view of the exercise device with the arms in a lower position. Referring to FIGS. 1 and 2, there is shown an exercise device 1 (hereafter also referred to as "device 1") configured to be secured within a doorway for performing exercises, and also configurable for use on a ground surface to perform exercises. FIG. 1 shows a general orientation of the device 1 when configured for doorway-mounted exercises.

Device 1 includes a horizontal platform assembly 20 and a pair of support arms 26 in parallel, spaced relation to one another that are attached to lateral ends of the platform assembly 20. The support arms 26 extend downward and may have a generally curvilinear shape beginning at an approximate midpoint thereof so that lower ends thereof extend forward of the platform assembly 20 (through a doorway) so as to be attached to a pivot assembly 30 arranged in a horizontal plane therebetween.

The pivot assembly 30 includes an elongate, hollow pivot bar 31 extending through apertures in the lower ends of the support arms 26 so as to be perpendicular to the support arms 26, and a pair of telescoping bar portions 38. Specifically, each telescoping bar portion 38 is inserted in each end of the pivot bar 31. Each telescoping bar portion 38 is retractable into and extensible out of its respective pivot bar 31 end. As will be described in further detail below, each telescoping bar portion 38 is engageable with front-facing, vertical door trim on each side of a doorway to assist in securing the exercise device 1 in the doorway with the platform assembly 20.

Device 1 further includes a pair of generally curvilinear pivot arms 44 in parallel, spaced relation to one another that are attached to the pivot assembly 30 at first ends thereof, with second ends extending away from the pivot assembly 30. The lower ends of the support arms 26, first ends of the pivot arms 44 and a portion of the telescoping bar portions 38 at the pivot bar 31 interface are secured to the pivot assembly 30 with a pair of clamp assemblies 47. Additionally, the lower end of each support arm 26 includes an indexing plunger 36 inserted through a corresponding spacer 34 so as to be threaded into the inner-facing side of its corresponding support arm 26.

Second ends of the pivot arms 44 are attached to grip assembly 50 arranged in a horizontal plane therebetween, and are secured to the grip assembly 50 with grip collar assemblies 60. As best shown in FIG. 2 and in somewhat similar fashion to the pivot assembly 30, an indexing plunger 36 is inserted through a corresponding spacer 34 and threaded into an inner-facing side of a corresponding plunger mount 58, which are components of the grip assembly 50.

To assist in the smooth functioning of the device 1, a plurality of washers 66 may be arranged along the pivot assembly 30 between each support arm 26 lower end and pivot arm 44 first end, along the grip assembly 50 between each grip collar assembly 60 and pivot arm 44 second end (on one side facing of the pivot arm 44), and between each pivot arm 44 and plunger mount 58 (on the other side facing of the pivot arm 44).

As best shown in FIG. 2, the platform assembly 20 includes an elongate horizontal bar 21, a pad 22, and a plurality of support fasteners 24. The pad 22 is adhered into an indentation in the front face of the horizontal bar 21. The horizontal bar 21 may be composed of a plastic, metal and/or natural fiber material, and may have a rigid rectangular structure; in another example it may be solid; in still another example it may be tubular and hollow, so long as it is sufficiently strong to remain rigid under load. The pad 22 provides a soft, non-marking surface to rest against the wall above a doorframe when the device 1 is mounted in a doorway. The pad 22 may be composed of a plastic or foam rubber material, for example. The support fasteners 24, which in an example are threaded, extend through holes formed in the upper end of each support arm 26 and into holes located on either lateral end of the horizontal bar 21.

In one example, the support arms 26 may be flat and curved in shape, and solid and rectangular in cross-section, and may be composed of a steel or hard plastic material. Each support arm 26 has a protruding tab with holes therein at an upper end thereof to receive fasteners 24 therethrough. The lower ends of the support arms terminate in a generally circular or disk shaped end. The upper portion of each support arm 26 extends vertically downward before curving forward. This vertical section allows the device to be mounted in doorways with sills that are taller than the standard 6.35 cm sills found in most homes. The curvature of the support arms 26 orients them so as to protrude through the opening of the doorway so as to position the pivot assembly 30 with its pivot bar 31 and telescoping bar portions 38 just forward of the front of the doorframe.

In an example, and centered along the body of the support arms 26 are a plurality of machined holes for the purpose of weight reduction. The circular disks forming the lower ends of the support arms 26 include two holes. A hole through the center of the disk is to receive the pivot bar 31 end of the pivot assembly 30. A lower hole is threaded for the insertion of the indexing plunger 36.

Figure 5:
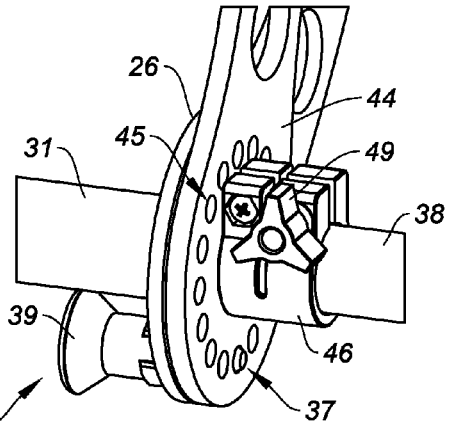
FIG. 5 is a dimetric view of the outlined area FIG. 5 in FIG. 3.
Figure 6:
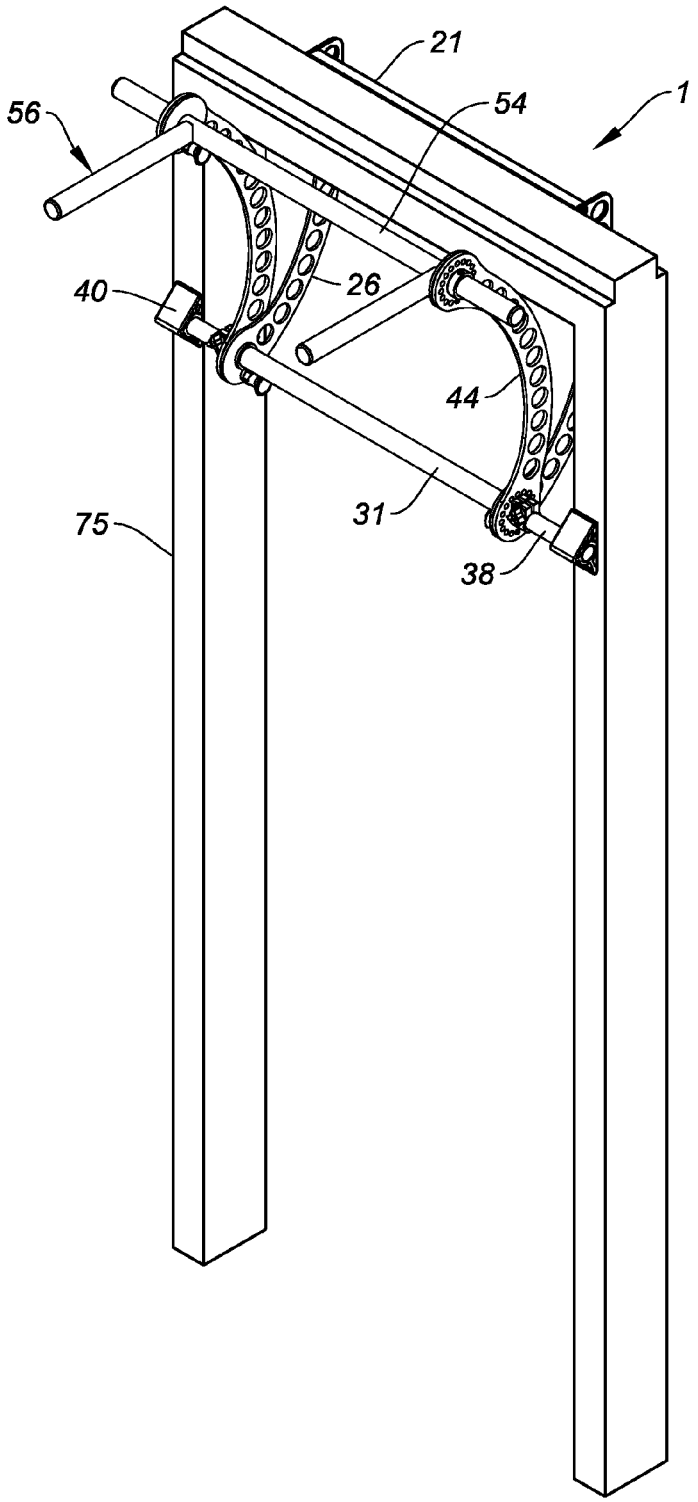
FIG. 6 is an isometric view of the exercise device mounted in a doorway.

As best shown in FIG. 5, each indexing plunger 36 is embodied to include an externally threaded plunger housing containing a spring-loaded pin 37 and handle 39 which has two positions. The first position, as illustrated in FIG. 5, is an engaged position in which the pin 37 extends from the plunger housing to engage one of a plurality of circular holes 45 machined into and around the periphery of the disk-shaped first end of the pivot arm. The second position is a disengaged one (not shown) in which the pin 37 is recessed into the plunger housing, and the handle 39 is pulled away from the plunger housing with only two lockout tabs making contact with the housing.

The indexing plungers 36 may be of a type commonly available through a number of hardware manufacturers. In an example, the indexing plungers 36 are made of a combination of plastic and steel, although other materials may be contemplated.

As best shown in FIG. 2, the pivot assembly 30 includes the pivot bar 31 and pivot collars 32 on either end thereof. The pivot bar 31 may be embodied as a tubular section of pipe greater in length than the horizontal bar 21, and may be composed of steel, a hard plastic material, and the like. The pivot collars 32 may be made of steel and are welded to the pivot bar 31, each an equal distance from either end of the pivot bar 31. The distance between outer sides of the pivot collars 32 is such that the inner sides of the support arms 26 rest against the pivot collars 32. Each pivot collars 32 is a ring with an inner diameter sufficient in size to accommodate the insertion of the pivot bar 31. In an example, the thickness and width of the pivot collar 32 is less than or equal to about 1.5 cm, as the purpose of the pivot collars is to set the position of the support arms 26 along the pivot bar 31.

The pivot assembly 30 further includes the telescoping bar portions 38, door stops 40, and door stop pads 42. Each telescoping bar portion 38 may be embodied as a tubular section of pipe made of steel and of sufficient length and outer diameter so that a distal end thereof fits into the door stop 40 and a proximal end thereof fits into the pivot bar 31 so as to meet the opposite telescoping bar portion 38 at the half-way point of the pivot bar 31. In an example, and approximately 10.16 cm from the inner end, each telescoping bar portion 38 may have a mark indicating a minimum insertion point.

The distal end of each telescoping bar portion 38 is inserted into a hole through the side of a corresponding door stop 40, as best shown in FIG. 1. The door stops 40 may be composed of a metal such as steel or a hard plastic, and may be either solid or hollow so long as the strength thereof is sufficient to withstand the stress of supporting a user's weight against a doorframe. Each door stop 40 may be triangular in shape when viewed from the lateral side, and rectangular in shape when viewed from the other three faces.

Each door stop pad 42 is adhered into an indentation in the front face of its door stop 40, and may have a pliable, rectangular structure. The door stop pads 42 may be formed of a foam rubber material so as to provide soft, non-marking surfaces to rest against the sides of a doorframe when the device 1 is mounted in a doorway.

The pivot arms 44 may be made of aluminum, steel or a hard plastic. Each pivot arm 44 terminates in a circular disc at both the first and second ends. In an example, and centered along the body of the pivot arm 44 may be eleven holes for the purpose of weight reduction. The circular disks forming the ends of the pivot arms 44 contain a number of holes. There is one large hole through the center of each disk of sufficient diameter to accommodate the insertion of the end of either the pivot assembly 30 or the grip assembly 50, which are equal in outer diameter. In a further example, a plurality of smaller holes is arranged in an evenly spaced circular pattern around the central hole of the disk-shaped end. These smaller holes are of a sufficient diameter to allow the easy insertion of the pin 37 of an indexing plunger 36.

As best shown in FIG. 2, each clamp assembly 47 includes a split clamp 46, inner clamp fastener 48, outer clamp fastener 49, and two hex nuts 52, respectively. The inner clamp fastener 48 is inserted through an appropriate hole in the front face of the split clamp 46, and secured in place by a hex nut 52 on the opposite side. The outer clamp fastener 49 is inserted through an appropriate hole in the front face of the split clamp 46 and secured in place by a hex nut 52 on the opposite side.

Each clamp assembly 47 acts as a clamp in two capacities. The first is to secure the lateral position of the support arms 26 and pivot arms 44 along the pivot assembly 30. This is accomplished by tightening the inner portion of the split clamp 46 against the pivot assembly 30 by screwing the inner clamp fastener 48 into its matching hex nut 52. The second capacity, according to example embodiments, is to secure the position of the telescoping bar portion 38 in relation to the pivot assembly 30. This is accomplished by tightening the outer portion of the split clamp 46 against the surface of its corresponding telescoping bar portion 38 by screwing the outer clamp fastener 49 into its matching hex nut 52.

Figure 4:
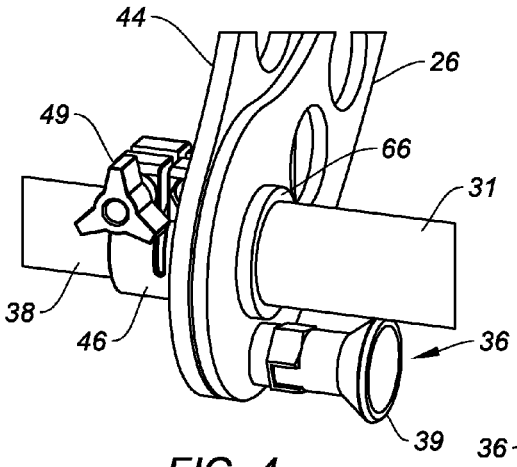
FIG. 4 is a dimetric view of the outlined area FIG. 4 in FIG. 3.

As best shown in FIGS. 4 and 5, and in an example, each split clamp 46 includes an upper tubular portion and a lower rectangular portion. Each split clamp 46 has two vertical splits running through it that allow it to act as a double clamp. The first vertical split extends laterally through the center of the lower rectangular portion of the split clamp 46. This first split provides the split clamp 46 the ability to clamp down on a tubular object.

The second vertical split extends through the front face of the split clamp 46, beginning approximately one-third of the outer diameter of the tubular portion of the split clamp 46 below the top of the split clamp 46 and continuing downward through its rectangular base. This second split allows the split clamp 46 to independently clamp onto both the pivot bar 31 of the pivot assembly 30 and the telescoping bar portion 38.

In other embodiments, each split clamp 46 has an inner and an outer segment, separated by the second split. The upper tubular portion of the inner segment of the split clamp 46 has an inner diameter sufficient in size to accommodate the insertion of the pivot assembly 30. The upper tubular portion of the outer segment of the split clamp 46 has an inner diameter of sufficient in size to accommodate the insertion of the telescoping bar portion 38. Therefore, in relation to one another, the inner diameter of the inner segment of the split clamp 46 is greater than that of the outer segment. The split clamp 46 has through-holes and indentations in both the front and back faces of the lower rectangular portions of the inner and outer segments to accommodate the insertion of an inner clamp fastener 48, an outer clamp fastener 49, and their corresponding hex nuts 52.

The inner clamp fasteners 48 may be standard machine screws of a length approximately equal to the distance between front and back faces of the lower rectangular portion of the split clamp 46. In an example, the inner clamp fasteners 48 are made of steel with Phillips heads, although materials and drives are suitable and contemplated herein.

The outer clamp fasteners 49 are knobs with threaded studs of a sufficient length to reach from the indentation for the face of the outer clamp fastener 49 to the back face of the lower rectangular portion of the split clamp 46. In an example, the outer clamp fasteners 49 are three-arm heads made of plastic and studs made of steel, although other head shapes and materials are suitable and contemplated herein. The hex nuts 52 may be standard machined steel hex nuts, although other materials are suitable and contemplated herein.

As best shown in FIG. 2, the grip assembly 50 includes a pull-up bar 54, two grip handles 56 spaced from one another thereon and extending in a plane perpendicular to a longitudinal axis of the pull-up bar 54, two plunger mounts 58, and end plugs 64. The pull-up bar 54 is arranged horizontally. Each grip handle 56 may be configured as a tubular section of steel pipe of at least 25.4 mm in length. The end of the grip handle 56 that is welded to the pull-up bar 54 is ground down or cut to fit the curvature of the face of the pull-up bar 54. The grip handles 56 are welded by their curved ends to the surface of the pull-up bar 54, approximately shoulder distance apart. The plunger mounts 58 are welded along the pull-up bar 54 and approximately tangent to the outside of the grip handles 56. Each plunger mount 58 may be embodied as a circular disc with two holes through the lateral face. The first hole cuts through the center of the disc and is of sufficient diameter to accommodate the insertion of the pull-up bar 54. The second hole is located vertically below the first hole and is threaded to accommodate the insertion of the indexing plunger 36. The end plugs 64 are inserted into the lateral ends of the pull-up bar 54 and the front facing ends of the grip handles 56. Each end plug 64 may be embodied as a tubular, plastic segment with a disc-shaped end cap segment. The outer diameter of the tubular segment is of a size to fit snugly into the ends of the grip handles 56 and pull-up bar 54. The outer diameter of the end cap segment is equal to the outer diameter of the grip handles 56 and pull-up bar 54. The outer face of the end cap segment is slightly rounded.

The pull-up bar 54 may be embodied as a tubular section of steel pipe of sufficient length to extend at least 11.4 mm beyond the outer lateral face of each plunger mount 58. The pull-up bar 54 contains two holes extending vertically through its diameter to accommodate the grip collar assemblies 60. These holes are located approximately 0.63 mm to the outside of the outer faces of the plunger mounts 58.

Each grip collar assembly 60 includes a grip collar 61 and a grip collar fastener 62. The grip collar fastener 62 is inserted into a hole located through the diameter of the grip collar 60. In an example, each grip collar 60 is a tubular, plastic segment approximately 1.27 mm in width. The inner diameter of the grip collar 60 is of sufficient size to allow the insertion of the pull-up bar 54. In certain embodiments, the outer diameter is approximately 1.01 mm greater that the inner diameter. There is a hole through the diameter of the grip collar 60, centered along the width, for the insertion of the grip collar fastener 62. The top portion of this hole contains an indentation for the head of the grip collar fastener 62. The bottom portion of the hole is threaded to accept the grip collar fastener 62.

The grip collar fasteners 62 may be standard machine screws of a length approximately equal to the outer diameter of the grip collars 60. In certain embodiments, the grip collar fasteners 62 are made of steel with Phillips heads, although other materials and drives are suitable and contemplated herein. The washers 66 are circular, plastic discs with an inner diameter sufficient to allow the insertion of pivot bar 31 of the pivot assembly 30 and the pull-up bar 54 of the grip assembly 50 therethrough, and an outer diameter equal to that of the grip collars 60. In an example, the thickness of the washers 66 is approximately 0.05 mm.

Operation

The example embodiments contemplated herein have at least three primary arrangements for use, a doorway-mounted configuration, a first ground configuration, and a second ground configuration, with a wide variety of sub-positions within these three arrangements. FIGS. 6-9 show a variety of views and sub-positions of the exercise device 1 mounted to a doorframe 75. The doorway-mounted arrangement is the first of the three arrangements of the device.

Doorway-mounted Arrangement—FIGS. 1-9

When mounted in a doorframe 75, the horizontal bar 21 of the device 1 sits centered on top of the back sill of the doorframe 75 (i.e., on the top surface of horizontal 75 trim extending along a rear facing wall directly above the doorframe 75). The pad 22 presses against the wall above the back of the doorframe 75, providing a soft, non-marking contact surface. The support arms 26 extend down from the platform assembly 21 and through the doorframe 75 opening. The lower disc ends of the support arms 26, pivot assembly 30, and first ends of the pivot arms 44 are thus positioned to the front-facing side of the doorframe 75. The door stops 40 attached to distal ends of the telescoping bar portions 38 make contact with the forward facing doorframe 75 trim to the sides of the doorframe 75. Contact is made between the doorframe 75 trim and the doorstop pads 42 on the door stops 40, providing soft, non-marking contact surfaces.

Exercise device 1 employs gravity and opposing force to maintain it and its user secure within the doorframe 75. Gravity acting on the horizontal bar 21 resting on top of the doorframe 75 sill provides the initial force to hold the device 1 in place. The pad 22 pushes against the wall above the doorframe 75 and the door stops 40 attached to distal ends of the telescoping bar portions 38 push against the front facing doorframe 75 trim to create opposing forces against the doorframe 75 and its surrounding wall. Because the majority of the force generated by the device 1 and its user is transmitted laterally against the doorframe 75 and its surrounding wall, instead of vertically against the top of the back doorframe 75 sill, the device 1 is secure in its position and able to support a significant amount of weight.

Figure 3:
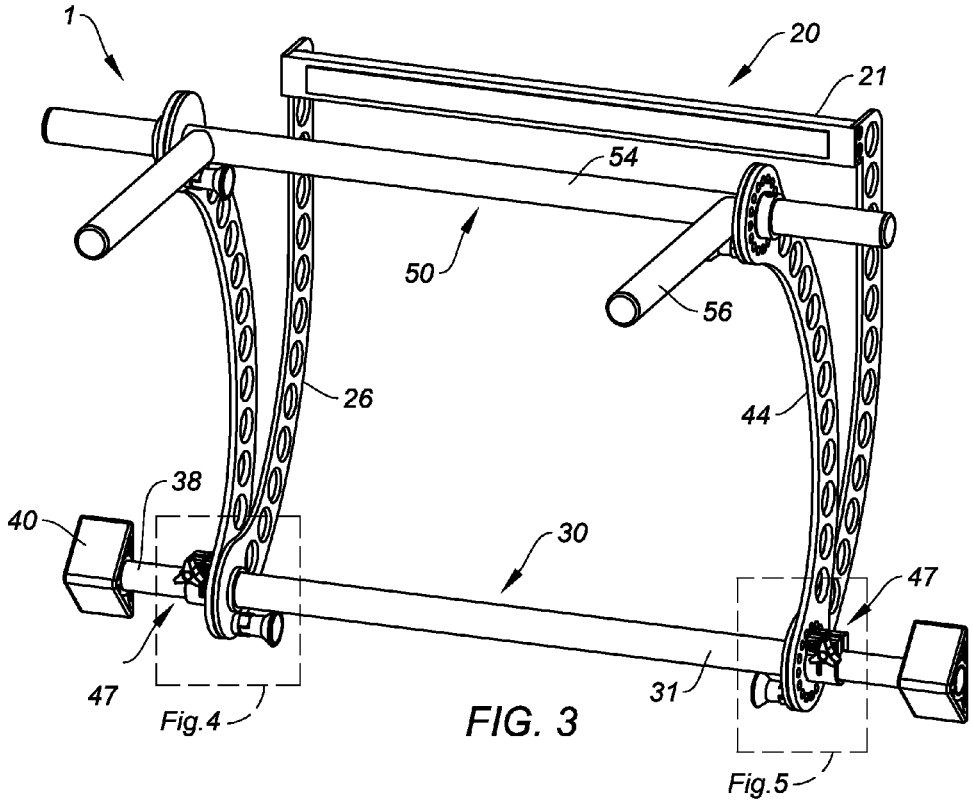
FIG. 3 is a dimetric view of the exercise device with the arms in an upper position.

Referring to FIGS. 3-5, details of the interaction between the indexing plungers 36, the disc-shaped lower ends of the support arms 26, and the disc-shaped first ends of the pivot arms 44 are described. When engaged, the pins 37 of the indexing plungers 36 extend through one of the plurality of smaller holes 45 formed into the periphery of the disc-shaped first end of the pivot arms 44 attached to the pivot bar 31 of the pivot assembly 30. This locks the pivot arms 44 in position relative to the support arms 26. When the pins 37 of the indexing plungers 36 are disengaged, the pivot arms 44 are free to rotate into other positions. Accordingly, the pivot arms 44 are configured to be rotated about the pivot bar 31 at their first ends so as to be oriented and secured in a plurality of different angular positions relative to the support arms 26.

In operation to adjust the position of the pivot arms 44 in relation to the support arms 26, a user holds onto the grip assembly 50 with one hand and disengages the indexing plungers 36 with the other hand. Disengagement is accomplished by pulling the handle 39 of the indexing plunger 36 and rotating it 45 degrees into the locked-out position. The user then rotates the pivot arms 44 into the desired position and re-engages the indexing plungers 36. The pins 37 of the indexing plungers 36 then extend into one of the plurality of holes 45 in the pivot arms 44 due to the spring-loaded force exerted outward on the pin 37.

The indexing plungers 36 interact with the grip assembly 50 and the pivot arms 44 in a manner similar to the interaction of the indexing plungers 36 with the support arms 26 and pivot arms 44. When engaged, the pins 37 of the indexing plungers 36 extend through one of the plurality of smaller holes 45 in the disk-shaped second ends of the pivot arms 44 that are attached to the grip assembly 50. This locks the grip assembly 50 in position relative to the pivot arms 44. When the pins 37 of the indexing plungers 36 are disengaged, the grip assembly 50 is free to rotate into other positions. Accordingly the pull-up bar 54 of the grip assembly 50 is configured to be rotatable within the central apertures at the disc-shaped second ends of the pivot arms 44 so that the grip handles 56 thereon can be oriented and secured in a plurality of different angular positions relative to the pivot arms 44.

In operation, the position of the grip assembly 50 is adjusted through a process similar to that used to adjust the position of the pivot arms 44. To adjust the position of the grip assembly 50 relative to the pivot arms 44 (specifically the grip handles 56 on pull-up bar 54 relative to the pivot arms 44), a user holds onto the grip assembly 50 with one hand and disengages the indexing plungers 36 with the other hand. The user then rotates the grip assembly 50 into the desired position and re-engages the indexing plungers 36.

Further, and in an alternative, means other than the indexing plungers 36 may be used for the adjustment and securing of pivot arms 44 and grip assembly 50 positions. For example, a compression force is provided by threaded collars 32 and 61 that screw onto the pivot bar 31 and pull-up bar 54 from the outer ends of the bars. The threaded collars 32 and 61 effectively sandwich the pivot arms 44 between the support arms 26 or grip collars and the threaded collars. Another alternative is to employ quick-release pins in place of the indexing plungers 36 that are removed and re-inserted with each adjustment.

Figure 7:
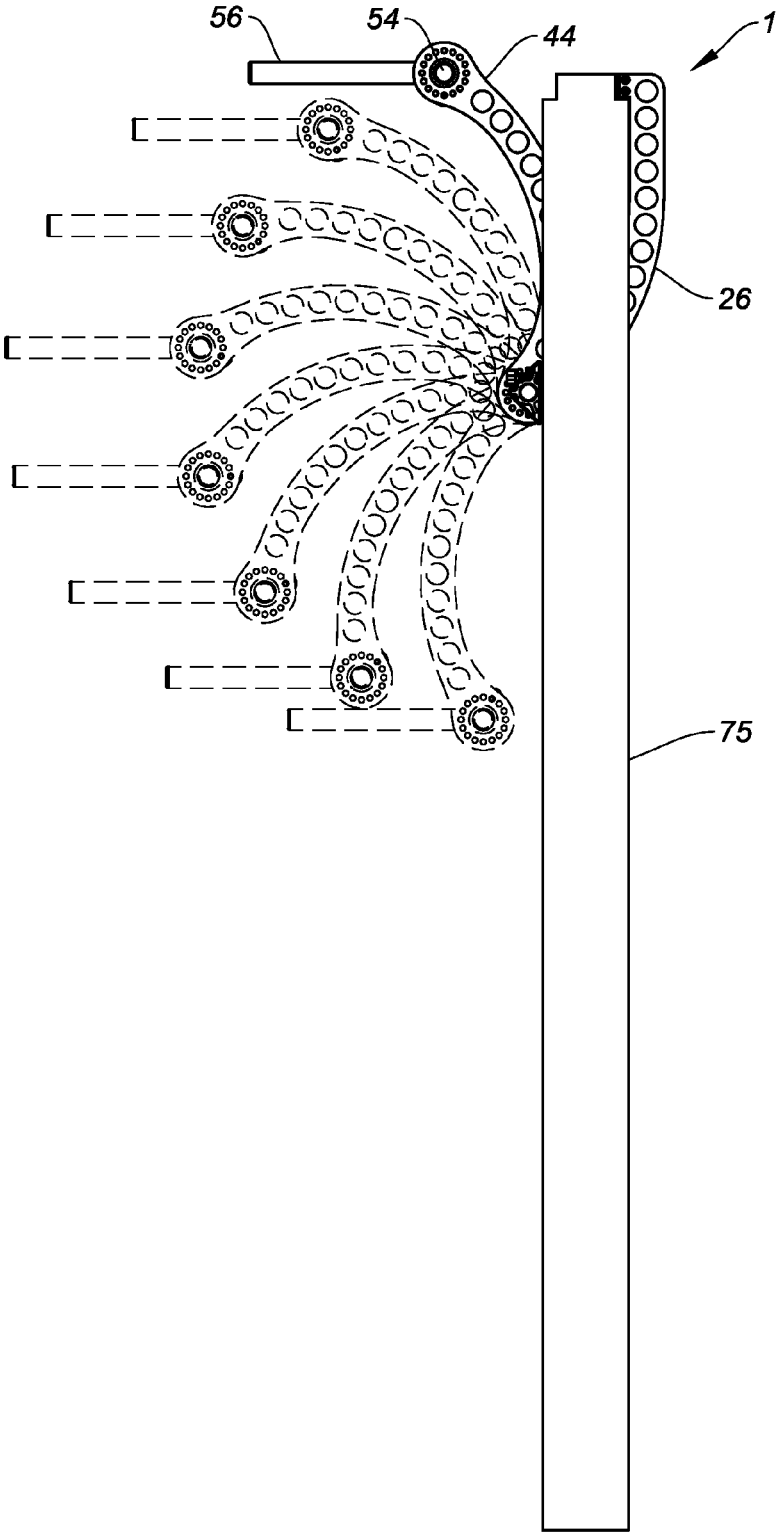
FIG. 7 is side view of the exercise device mounted in a doorway with various arm positions shown.
Figure 16:
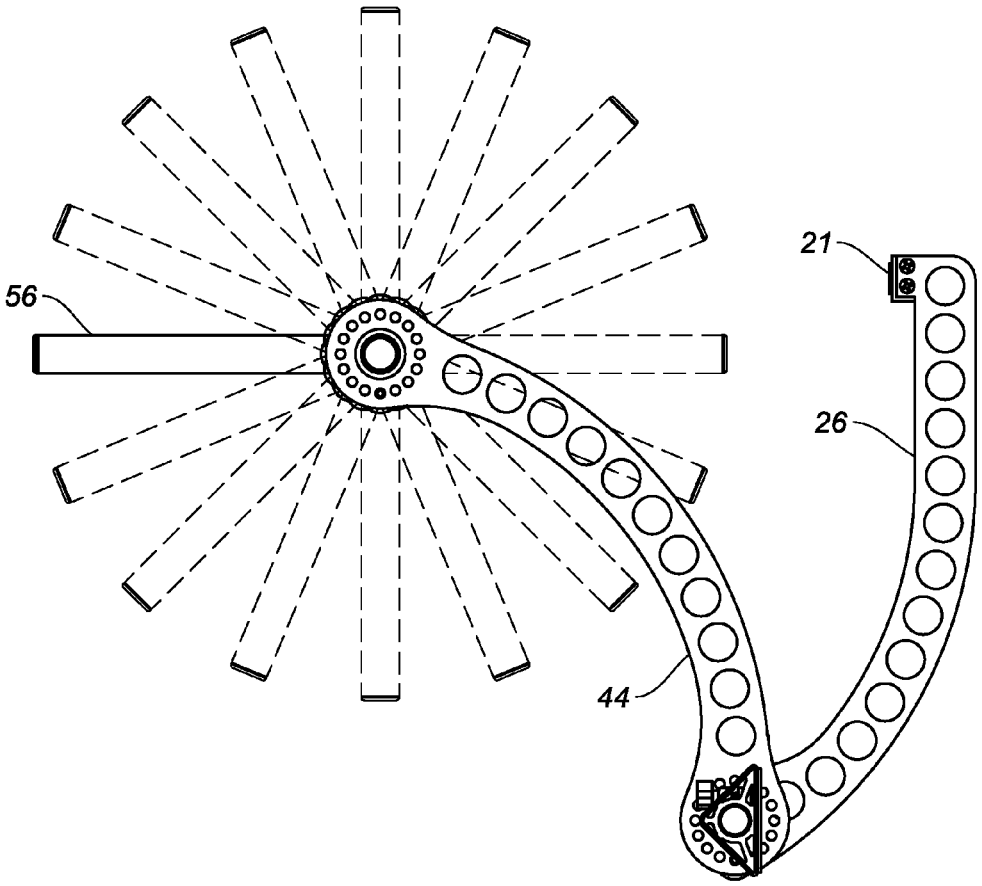
FIG. 16 is a side view of the exercise device with various grip positions shown.

FIG. 7 is a side view of the exercise device 1 installed in doorframe 75, showing eight possible positions for the pivot arms 44 and grip assembly 50 in the doorway-mounted arrangement. FIG. 16 is a side view of sixteen possible positions of the grip handles 56 on pull-up bar 54 in the grip assembly 50, in relation to the pivot arms 44, according to the example embodiments. The combinations of these various pivot arm 44 and grip assembly 50 positions allow for the performance of a wide range of exercises in the doorway-mounted arrangement.

The pull-up bar 54 provides users the ability to perform pull-ups, chin-ups, and bodyweight rows with varying grip widths. The pull-up bar 54 also offers users the ability to perform hanging knee-raises and leg-raises, and hanging sit-ups. The grip handles 56 provide users the ability to perform dips, neutral-grip pull-ups, knee-raises and leg-raises.

Additionally, the grip handles 56 allow for the execution of a type of pull-up proprietary to the device 1. This pull-up is performed from the grip handles 56 when the grip assembly 50 is positioned so that the grip handles 56 are oriented in a downward direction, either completely vertical or angled. The downward direction of the grip handles 56 requires a greater effort to maintain the user's grip thereon than for standard pull-ups, thereby allowing for greater strengthening of the muscles involved in gripping. This type of pull-up is referred to as an "ice pick" pull-up, due to its similarity to the grip involved in the sport of ice climbing.

Still further, the various arm positions permit exercises to be performed at varying heights from the ground surface. This adjustability accommodates users of varying heights, as well as permits users to perform assisted versions of the pull-up and chin-up exercises by enabling them to maintain their feet on the ground throughout the movement. The doorway-mounted arrangement for device 1 may also act as an anchor for the numerous exercise straps, bands, and Olympic rings currently popular for resistance training and physical therapy.

FIGS. 2-5 further detail the relationship of the clamp assemblies 47 to the pivot assembly 30 and more specifically to the pivot bar 31 and telescoping bar portions 38, according to this example embodiment. The pivot arms 44, washers 66, and support arms 26 are secured laterally along the pivot assembly 30 by the clamp assemblies 47, specifically the inner clamp segment of the split clamp 46. The inner segment of the split clamp 46 remains securely clamped to the pivot assembly 30 throughout the use of the device 1. The outer segment of the split clamp 46 is capable of being loosened and tightened along the length of the telescoping bar portions 38 to allow the telescoping bar portions 38 to slide in or out of the pivot bar 31 and to secure the telescoping bar portions 38 in place. The outer clamp fastener 49 of the clamp assembly 47 is outfitted with a knob to accommodate the quick, tool-less adjustment of the position of the telescoping bar portions 38.

Figure 8:
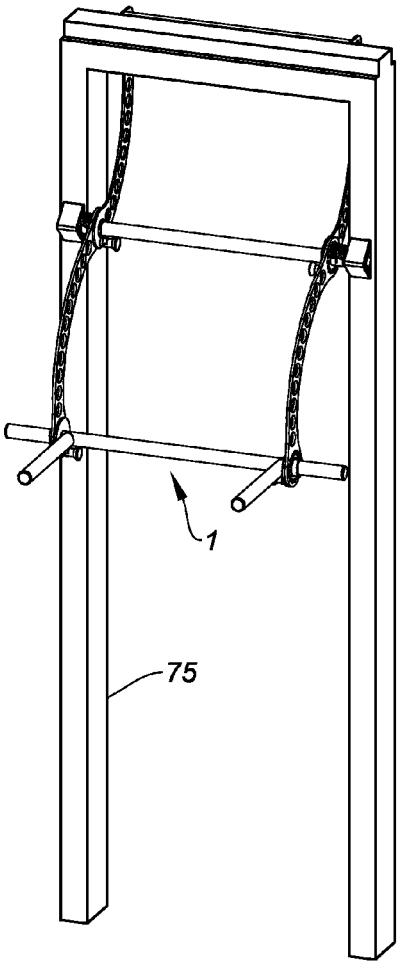
FIG. 8 is an isometric view of the exercise device mounted in a narrow doorway.
Figure 9:
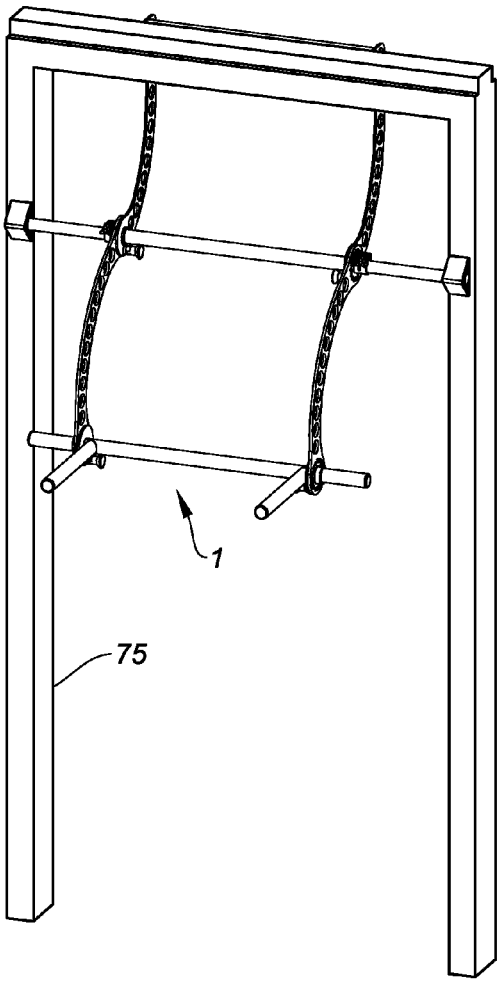
FIG. 9 is an isometric view of the exercise device mounted in a wide doorway.

FIGS. 8 and 9 are dimetric views of the exercise device 1 in a narrow and a wide doorframe 75, demonstrating the adjustability of the telescoping bar portions 38. These positions are attained via the loosening and tightening of the outer segments of the clamp assemblies 47 in conjunction with the lateral movement of the telescoping bar portions 38.

Each telescoping bar portion 38 occupies any intermediary position between the narrow and the wide positions. In still further embodiments, the telescoping ability of the telescoping bar portions 38 allows the device 1 to be offset to either side within a doorframe 75 in case of a wall or other object preventing the device from being centered in the doorframe 75.

First Ground Configuration: Floor Arrangement—FIGS. 10-13

Figure 10:
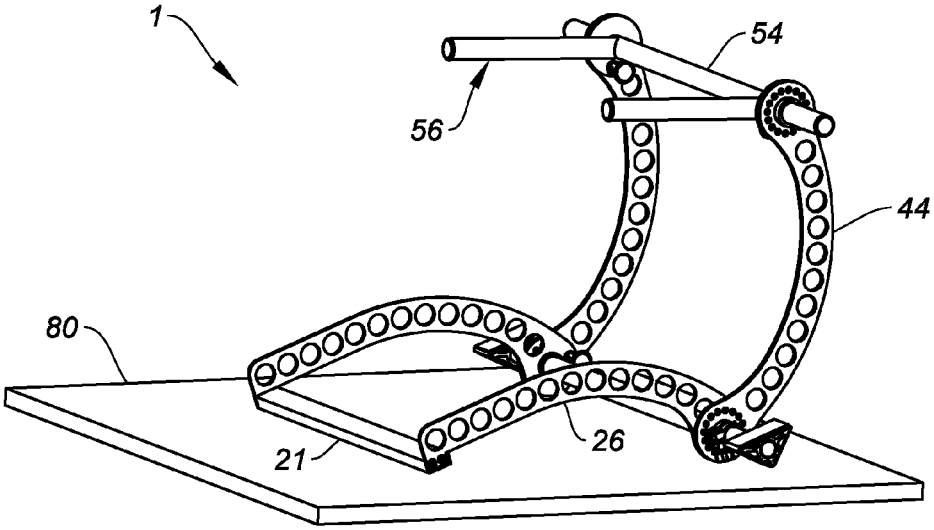
FIG. 10 is a perspective view of the exercise device on a floor segment with the arms in an upper position.

FIG. 10 shows a perspective view of example embodiments of the device positioned on a floor segment 80 (i.e., ground surface) in one of its possible positions. The floor arrangement is the second of the three device configurations for the exercise device 1. In the floor arrangement, the top front edge of the horizontal bar 21 and the disc-shaped ends of the support arms 26 and pivot arms 44 that are secured along the pivot assembly 30 are in contact with the floor segment 80. More specifically, with the exercise device 1 in this first ground configuration, the horizontal bar 21, lower disc-shaped ends of the supports arms 26, and adjacent disc-shaped first ends of the pivot arms 44 serve as contact points with the ground surface. The support arms 26 extend generally parallel to the floor segment 80 so that curved portions thereof do not contact the floor segment 80. The pivot arms 44 are secured in an angular position relative to the support arms 26 so as to extend generally upward from their first ends at the floor segment 80, their second ends supporting the pull-up bar 54 and grip handles 56 of the grip assembly 50 above the floor segment 80

Figure 11:
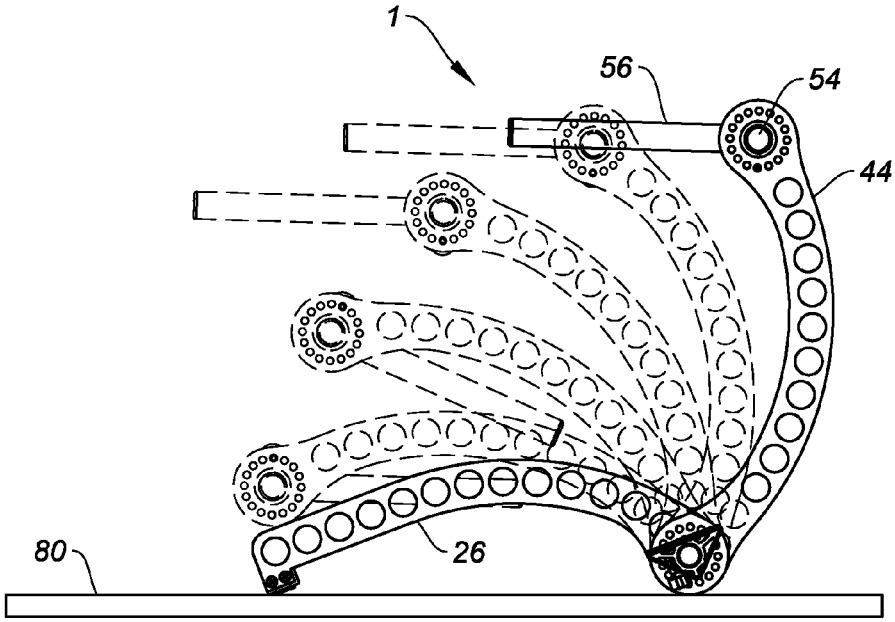
FIG. 11 is a side view of the exercise device on a floor segment with various arm positions shown.
Figure 12:
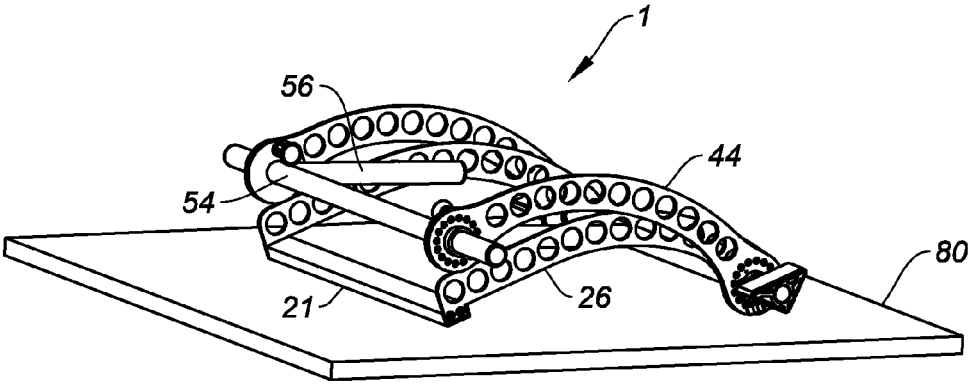
FIG. 12 is a perspective view of the exercise device on a floor segment in a first closed position.

FIG. 11 is a side view of the exercise device 1 on the floor segment 80 with various arm positions shown; FIG. 12 is a perspective view of the exercise device 1 on the floor segment 80 in a first closed position; and FIG. 13 is a perspective view of the exercise device 1 on the floor segment 80 in a second closed position.

There are at least five positions that the pivot arms 44 take in the floor arrangement through the use of the indexing plungers 36. These positions are shown in FIG. 11. In other embodiments, the grip assembly 50 occupies any of the sixteen positions shown in FIG. 16, so long as the grip handles 56 are not inhibited by the floor segment 80 or horizontal bar 21.

In each of the five positions shown in FIG. 11, the pull-up bar 54 is capable of being used to perform push-ups using a variety of grip widths. The grip handles 56 can be used to perform assisted dips in the upper three positions of FIG. 11, which show the grip handles 56 extending away from the pivot arms 44. The lowest arm position of FIG. 11 is also one of the closed positions for the device 1. This first closed position is shown in a perspective view in FIG. 12.

Figure 13:
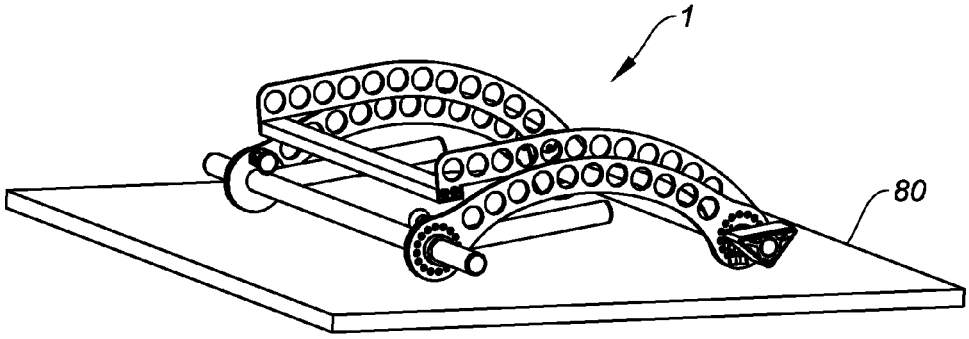
FIG. 13 is a perspective view of the exercise device on a floor segment in a second closed position.

A second closed position is shown in FIG. 13. In the second closed position, the device 1 rests on the floor segment 80 supported by the disc-shaped lower ends of the support arms 26 and disc-shaped first ends of the pivot arms 44 that are secured along the pivot assembly 30, and also rests on the disc-shaped second ends of the pivot arms 44 and adjacent plunger mounts 58 along the pull-up bar 54 of the grip assembly 50. In both of the closed positions, the telescoping bar portions 38 are inserted as far as they are able into the pivot bar 31. These closed positions allow for the convenient storage and transportation of exercise device 1 in its most compact arrangement.

Second Ground Configuration: Rocking Arrangement—FIGS. 14-15

Figure 14:
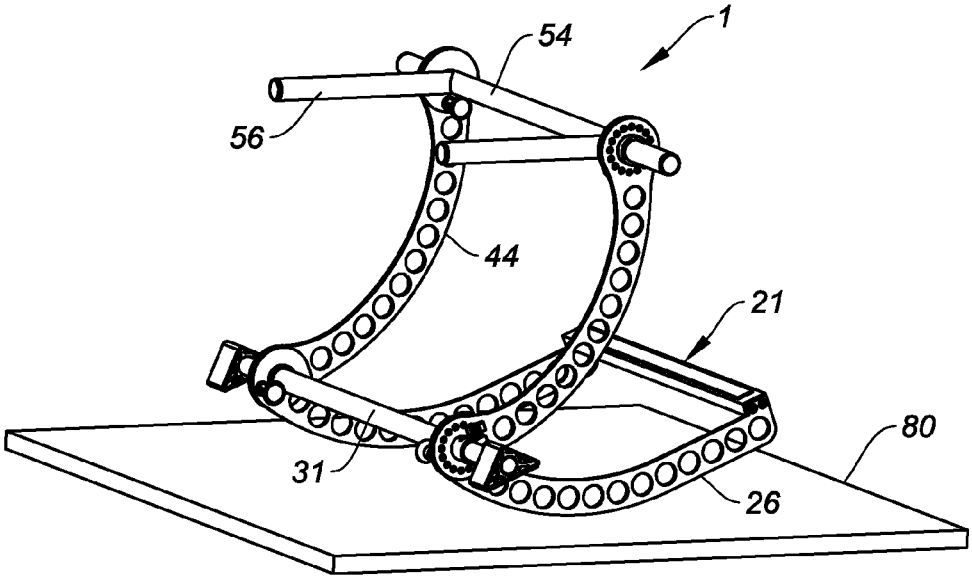
FIG. 14 is a perspective view of the exercise device on a floor segment in a rocking arrangement.

FIG. 14 shows a perspective view of the device 1 positioned on the floor segment 80 in one of its possible positions in a manner that allows it to rock back and forth. This second ground configuration (rocking arrangement) is the final of the three configurations for the device 1. In this rocking arrangement, the device 1 rests on the backs of the support arms 26. The curvature of the support arms 26 permits the device 1 to rock back and forth with the movement of the user.

Accordingly, with the exercise device 1 in the second ground configuration, only the curved portions at approximate midpoints of the support arms 26, which extend generally parallel to the ground surface (i.e., floor element 80), contact the ground surface between the horizontal bar 21 and pivot bar 31 so that exercise with an instability introduced is possible with the device 1. The pivot arms 44 are securable in an angular position relative to the support arms 26 so as to extend generally upward from their first ends and away from the ground surface. The second ends of the pivot arms 44 support the grip assembly 50 (e.g., pull-up bar 54 with grip handles 56) above the ground surface.

Figure 15:
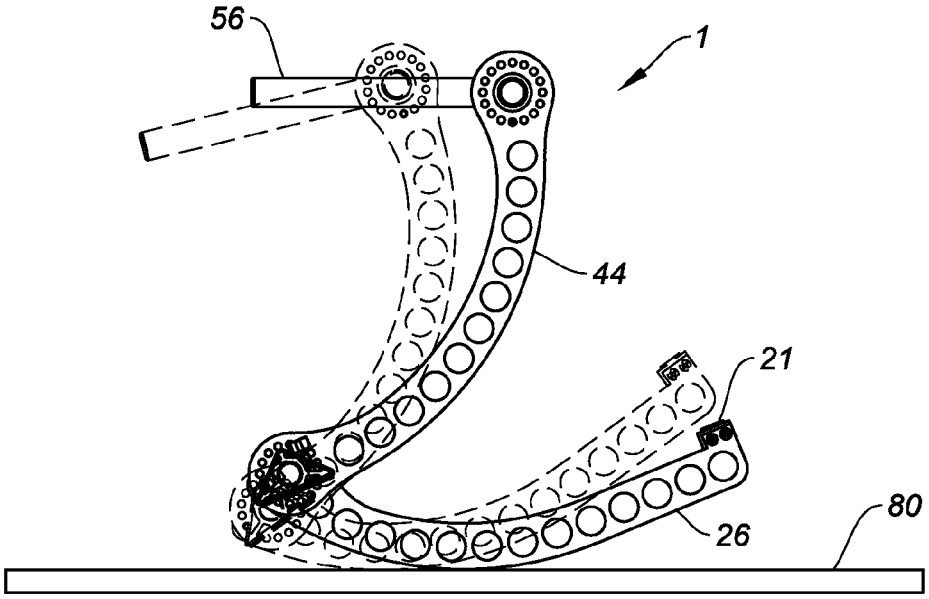
FIG. 15 is a side view of the exercise device on a floor segment in a rocking arrangement and shows the position of the device when rocked forward.

FIG. 15 is a side view of the rocking arrangement which also shows the position achieved by the device 1 when it is rocked forward. In this rocking arrangement, the device 1 may be used to perform abdominal crunches. Rocking crunches are accomplished by the user lying down between the pivot arms 44 of the device 1 with his or her lower back resting against the pivot bar 31, his or her head resting against the pad 22, and his or her hands gripping the pull-up bar 54. The user then tightens his or her abdominal muscles to rock the device 1 forward.

Still further, more advanced users may take advantage of the instability of the rocking arrangement to perform more challenging variations of push-ups and dips using the pull-up bar 54 and the grip handles 56. These exercises can be performed with a number of possible pivot arm 44 and grip assembly 50 positions in the rocking arrangement, so long as the user can maintain his or her balance throughout the movement.

Alternative Exercise Device Constructions—FIGS. 17-34

Figure 17:
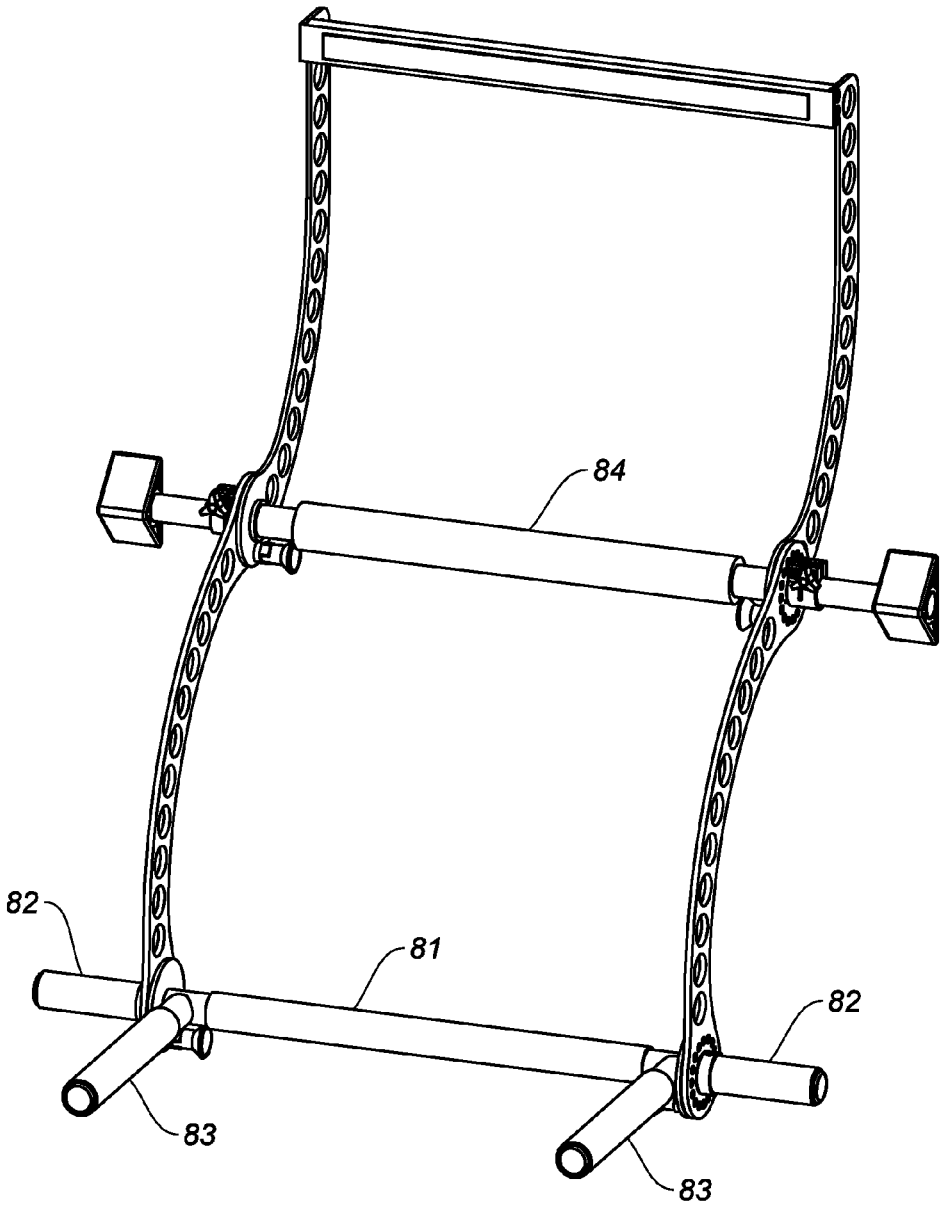
FIG. 17 is a dimetric view of the exercise device with padded portions.

A dimetric view of yet another example embodiment is shown in FIG. 17. This embodiment is similar to the previous described embodiments, but adds padding along portions of the device. A long pad 81 and two short pads 82 envelop the gripping portions of the pull-up bar 54. Two medium pads 83 envelop the gripping portions of the grip handles 56. A back pad 84 envelops the pivot bar 31 between the pivot collars 32. This embodiment provides the user with the benefit of padded gripping surfaces, as well as padded back rests for some of the exercise possibilities.

Figure 18:
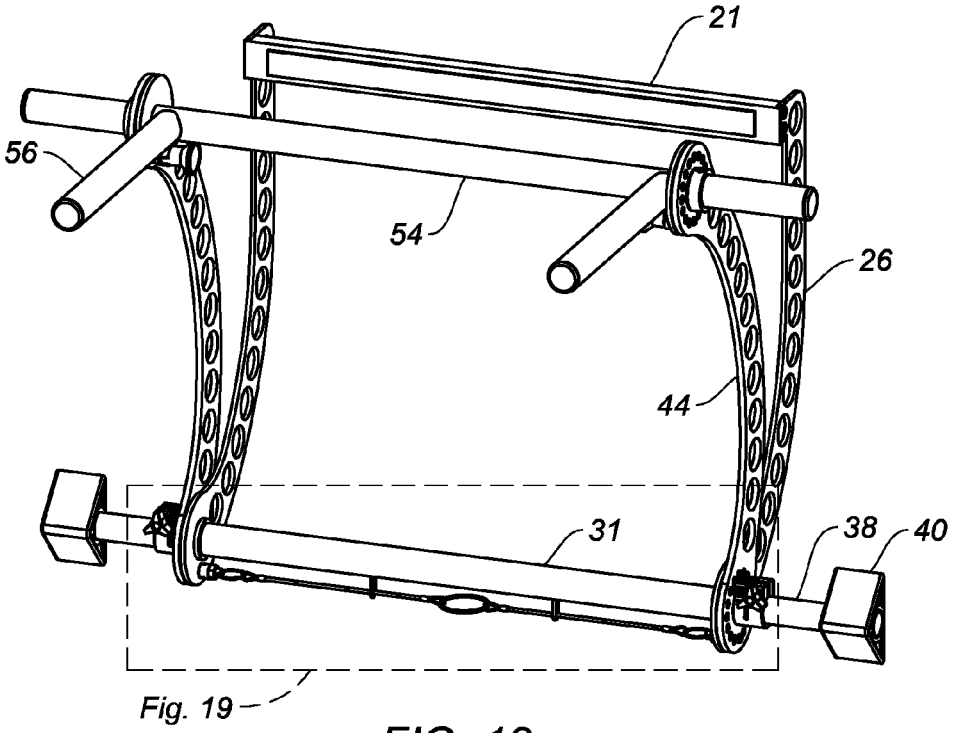
FIG. 18 is a dimetric view of the exercise device with a simultaneous release mechanism for two of the indexing plungers.
Figure 19:
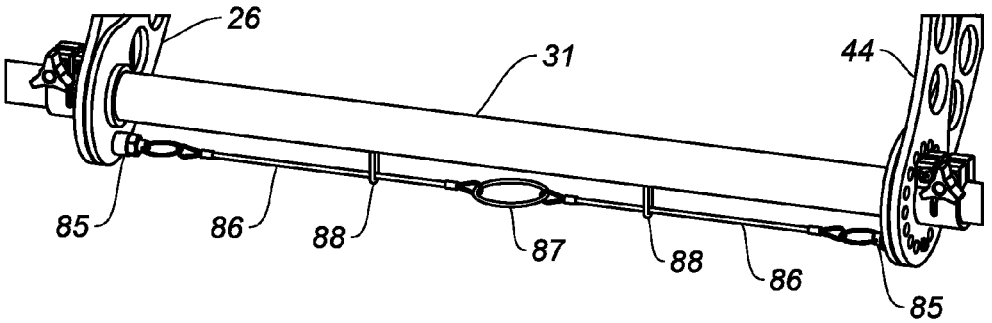
FIG. 19 is a dimetric view of the outlined area FIG. 19 in FIG. 18.

A dimetric view of yet another example embodiment of the device 1 is shown in FIGS. 18 and 19. This embodiment is similar to the above-described embodiments, but utilizes a different type of indexing plunger threaded into the support arms 26, and a mechanism for engaging and disengaging the indexing plungers simultaneously.

As shown in FIG. 19, ring plungers 85 are threaded into the inner faces of the support arms 26. Cords 86 are connected to the ring plungers 85. The cords 86 extend toward each other from the ring plungers 85 and connect to a ring 87 below the center of the pivot bar 31 of pivot assembly 30. Cord brackets 88 extend from the bottom of the pivot assembly 30 to support the cords 86. The cord brackets 88 are spaced an equal distance from the middle of the pivot bar 31. This embodiment offers a convenient single-handed release mechanism for adjusting the pivot arm 44 positions.

Figure 20:
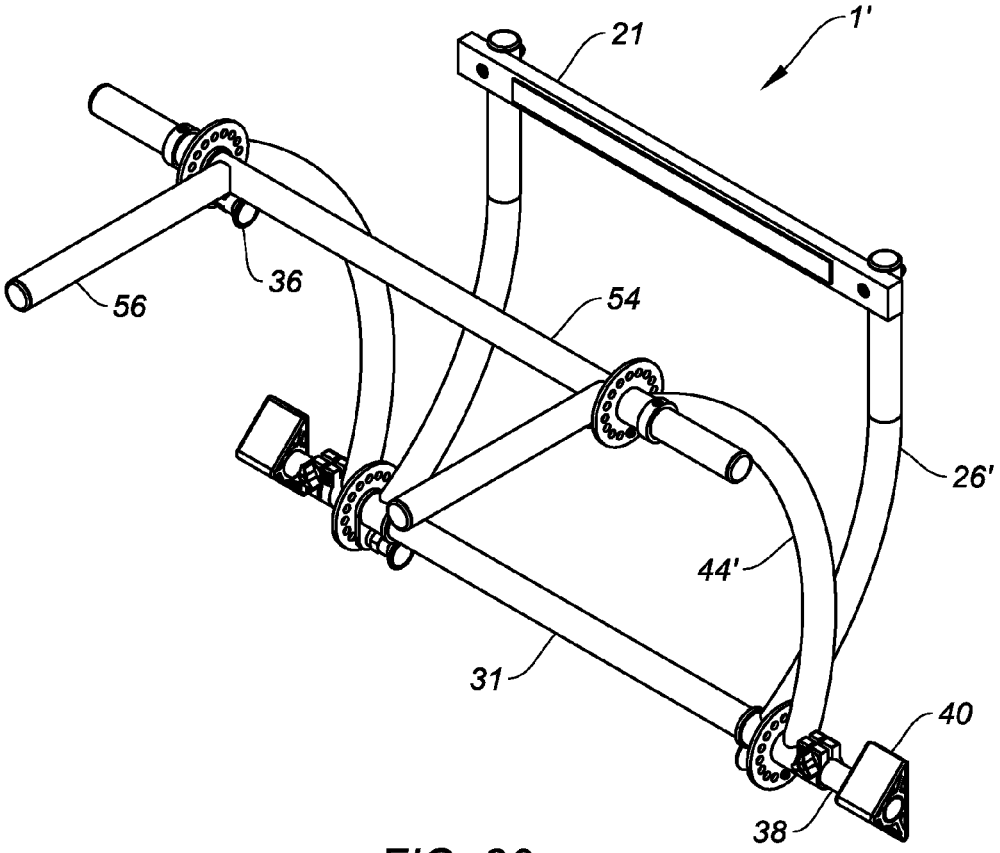
FIG. 20 is an isometric view of an exercise device according to another example embodiment with the arms in an upper position.

An isometric view of yet another example embodiment is shown in FIG. 20. In this embodiment, the support arms 26' and pivot arms 44' of an exercise device 1' are tubular instead of flat. Although circular tubing is shown, tubing of other shapes is contemplated herein.

Figure 21:
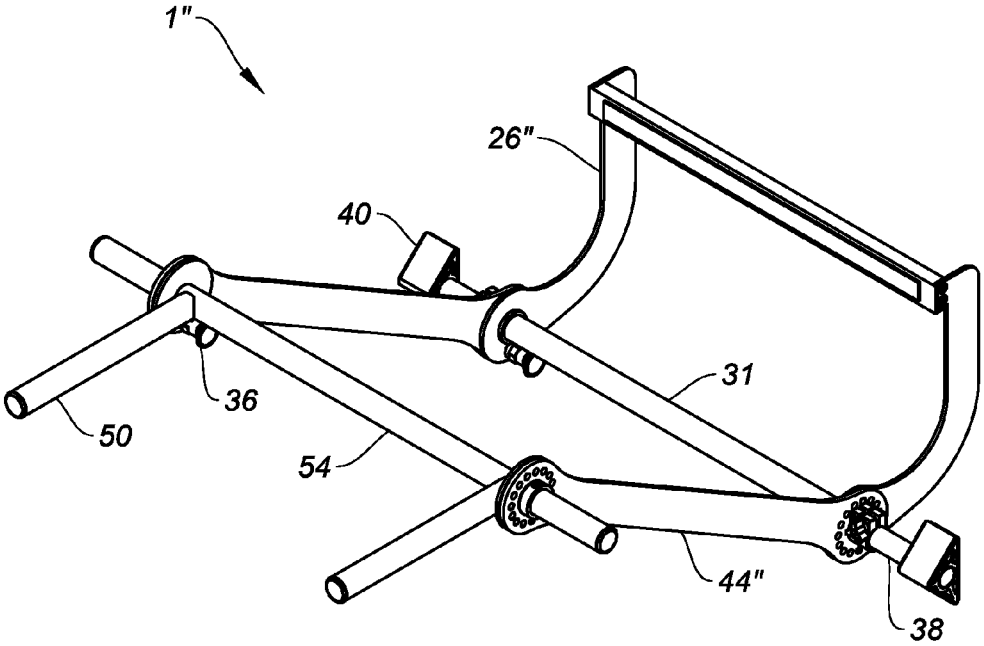
FIG. 21 is an isometric view of an exercise device according to another example embodiment with the arms in an upper position.
Figure 22:
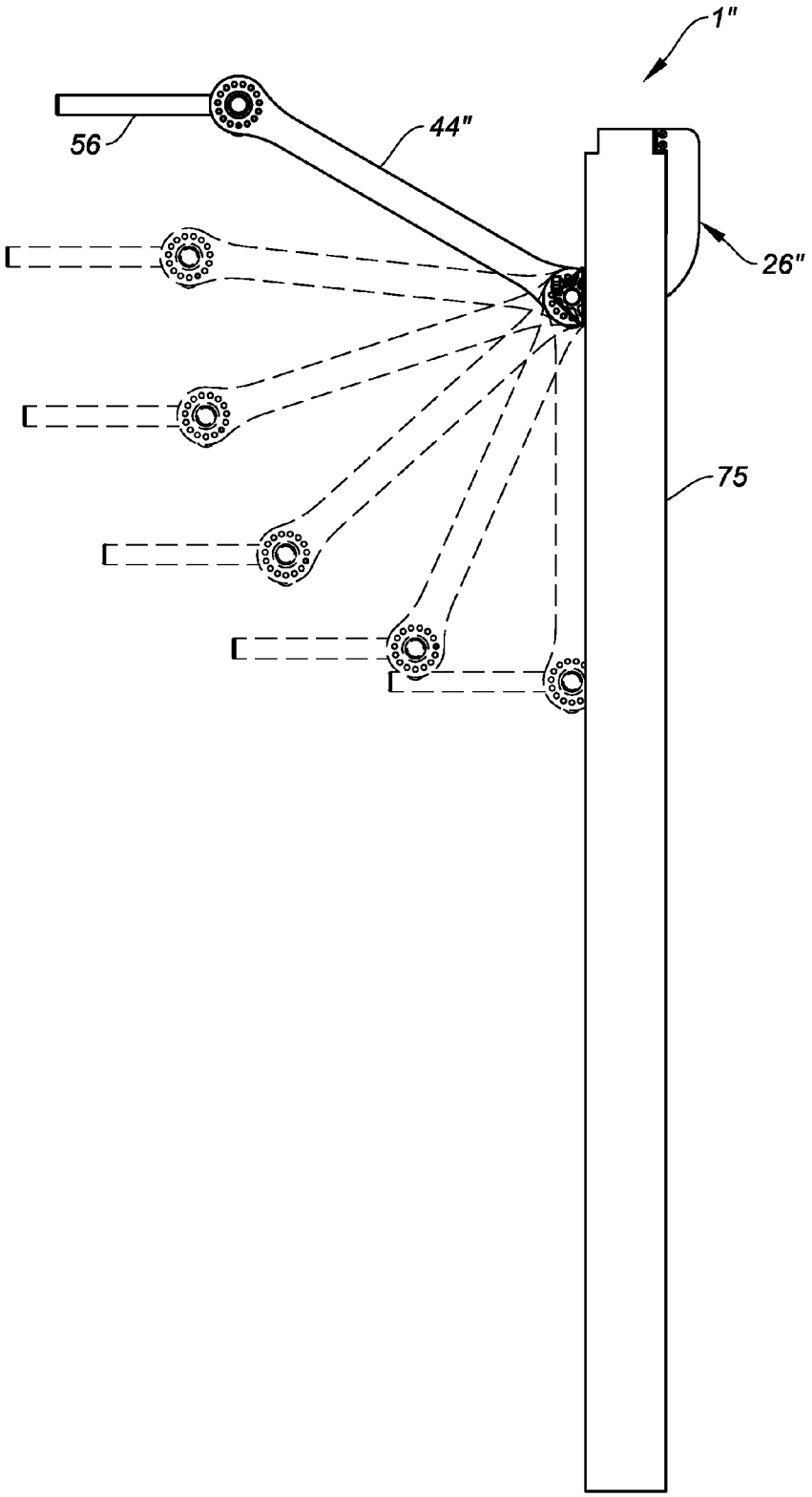
FIG. 22 is a side view of the exercise device of FIG. 21 mounted in a doorway with various arm positions shown.

An isometric view of an example embodiment mounted in a doorframe 75 is shown in FIGS. 21 and 22. In this example embodiment, an exercise device 1" is shown where the support arms 26" have been shortened and the pivot arms 44" lengthened and straightened. The shorter support arms 26" allow most users to walk through a doorway with the device 1" in place without the need to duck, so long as the pivot arms 44" are in one of their higher configurations. FIG. 22 shows a side view of the various arm positions possible when the device 1" is mounted to doorframe 75.

Figure 23:
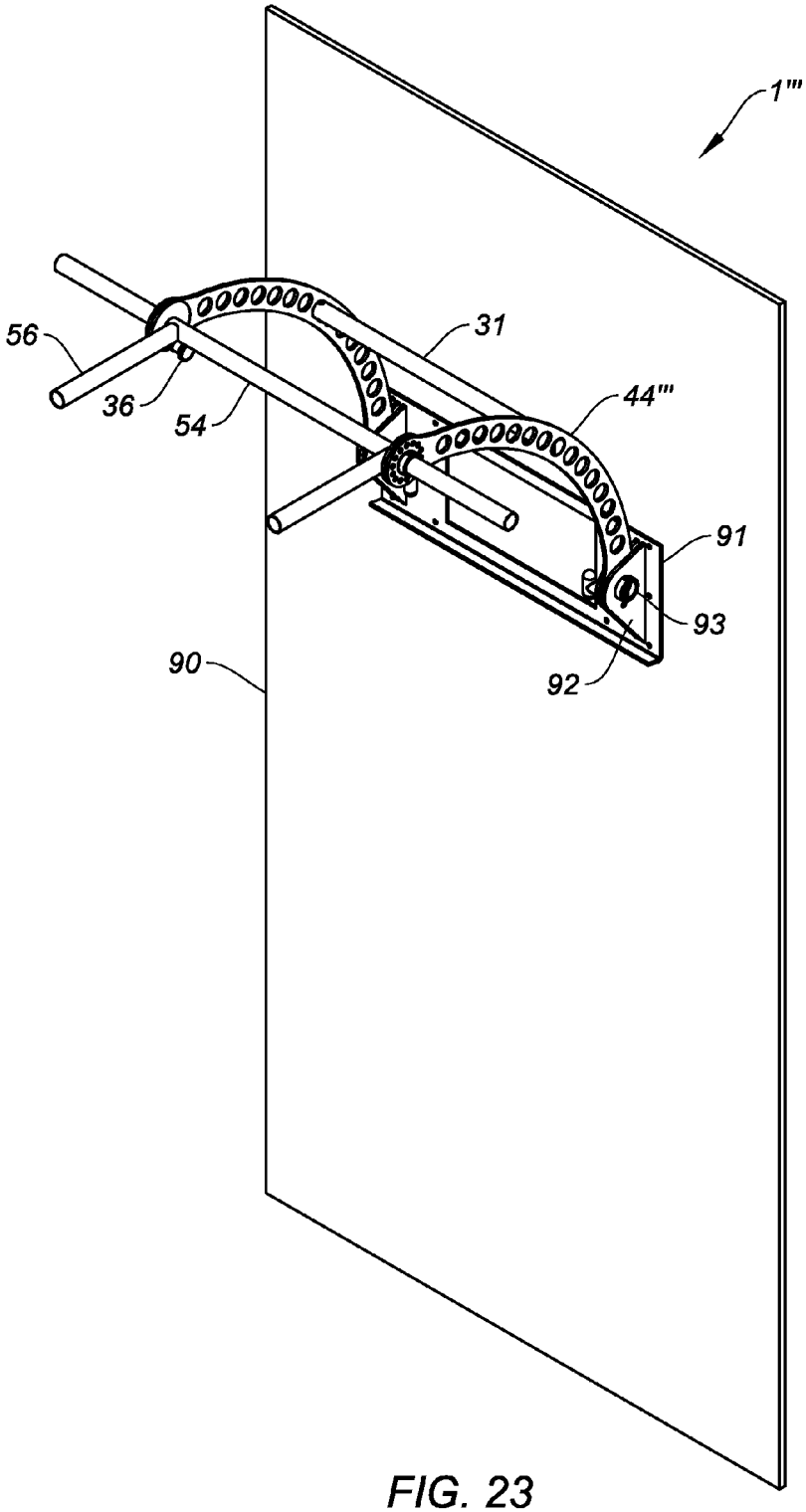
FIG. 23 is an isometric view of an exercise device according to another example embodiment mounted on a wall segment with the arms in an upper position.
Figure 24:
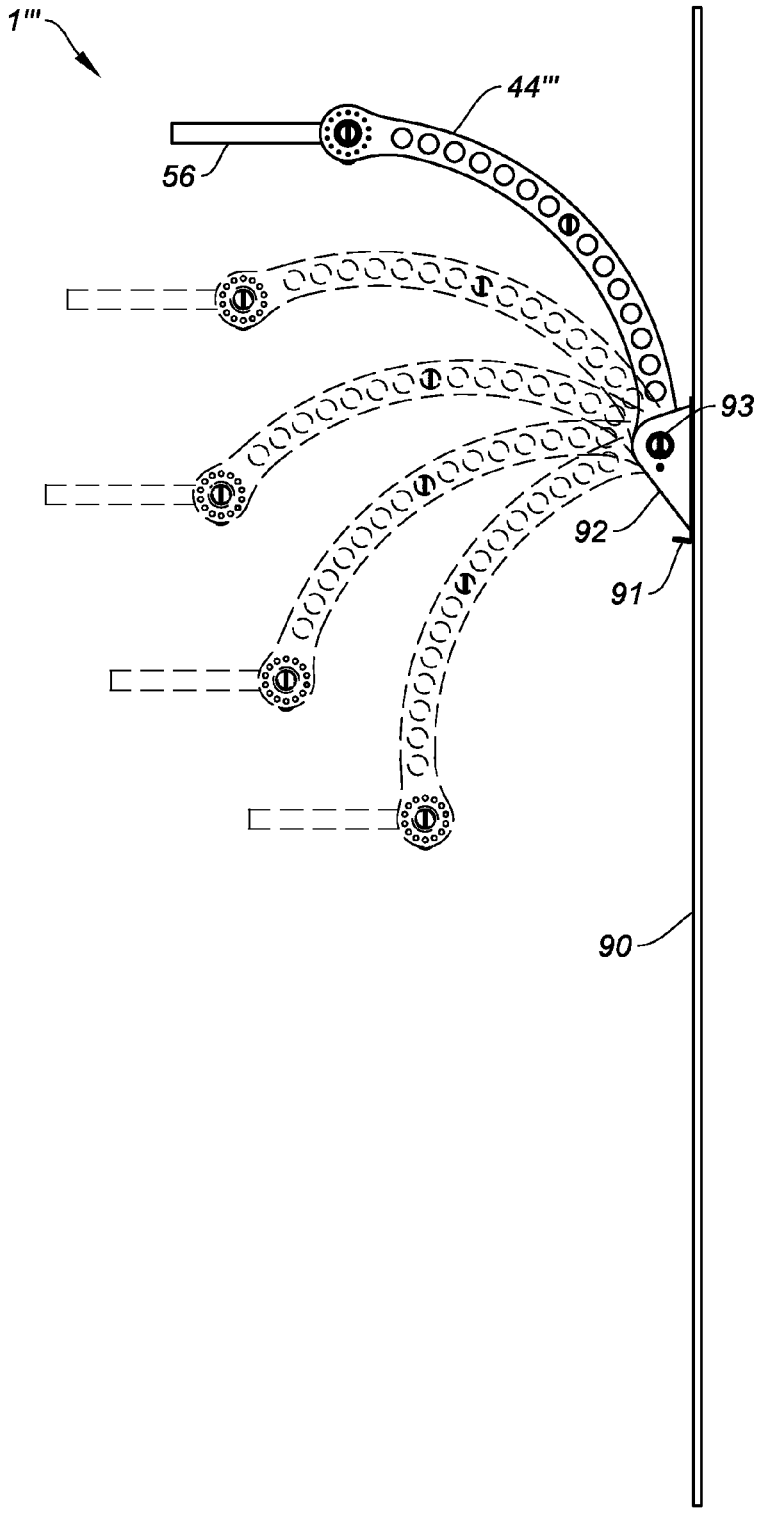
FIG. 24 is a side view of the exercise device of FIG. 23 mounted on a wall segment with various arm positions shown.

An isometric view of yet another exercise device 1' is shown in FIGS. 23 and 24. This embodiment allows users to secure the device 1' directly to a wall 90 for a more stable exercise platform. Here, the support arms 26 are eliminated, and the device 1'" includes a plate 91 secured to the wall 90, the plate 91 having a pair of spaced brackets 92 connected to first ends of semi-circular pivot arms 44'". A pivot bar 31 is connected midway up the pivot arms 44'" therebetween, with a pull-up bar 54 and its grip handles 56 thereon connected within disc-shaped second ends of the pivot arms 44'". A pivot bar 93 inserted into each bracket 92 and attached to the disc-shaped first ends of the pivot arms 44'" permits angular rotation thereof, relative to the plate 91.

Kipping pull-ups have become popular in some segments of the fitness community, and this wall-mounted embodiment will allow for such dynamic movements. The pivot arms 44'" of this embodiment are longer than those previously described, making the top position higher and the bottom position lower, and thus catering to a greater percentage of the population. This embodiment is an excellent replacement for the pull-up and dip towers found in most commercial gyms since it has a much smaller space requirement and better accommodates users of varying heights.

Standing work stations have increased in popularity in recent years. The height of the lower positions of example embodiments is ideal for the attachment of a work surface to the tops of the grip handles 56. Such a work surface can have numerous uses depending on the angle of the grip handles 56. Such uses include, but are not limited to, a desk, drawing board, projection screen, mount for a dart board, or shelf. Other embodiments of the device 1 may provide a mount for a work surface.

Figure 25:
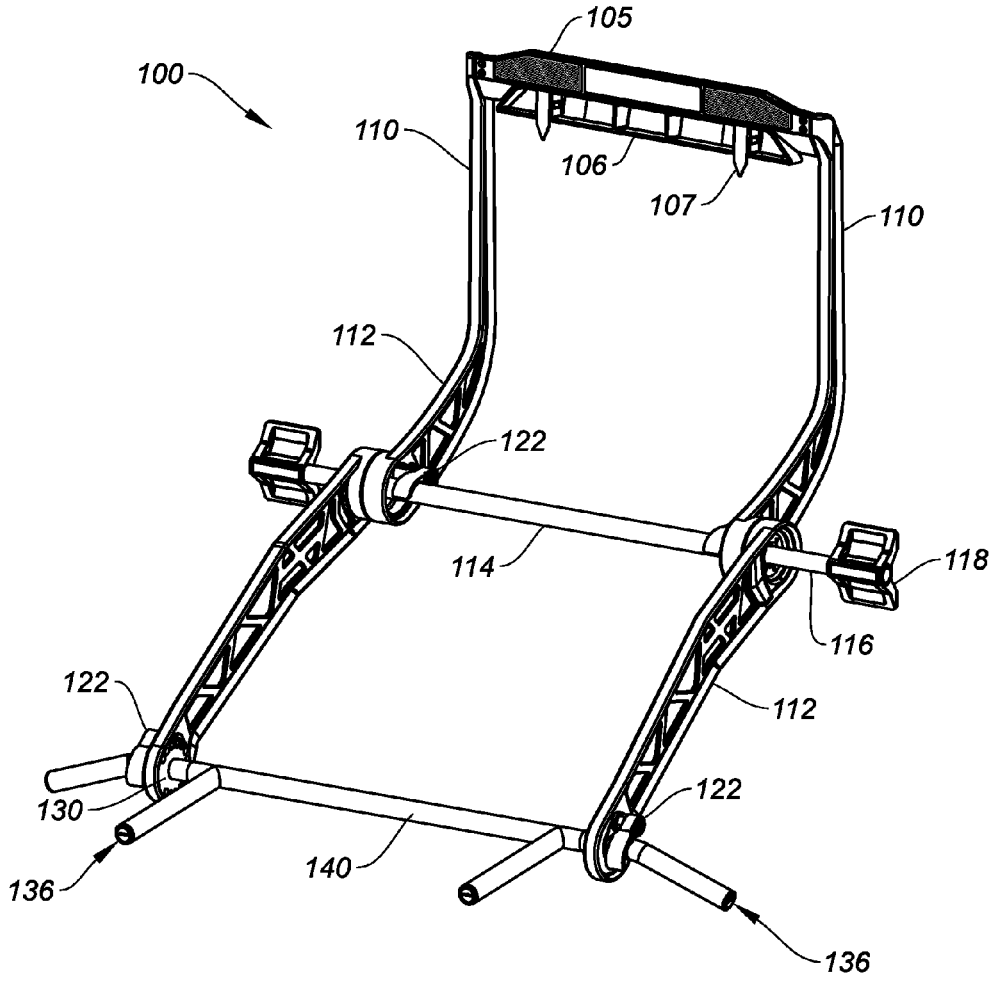
FIG. 25 is a perspective view of an exercise device according to another example embodiment.
Figure 26:
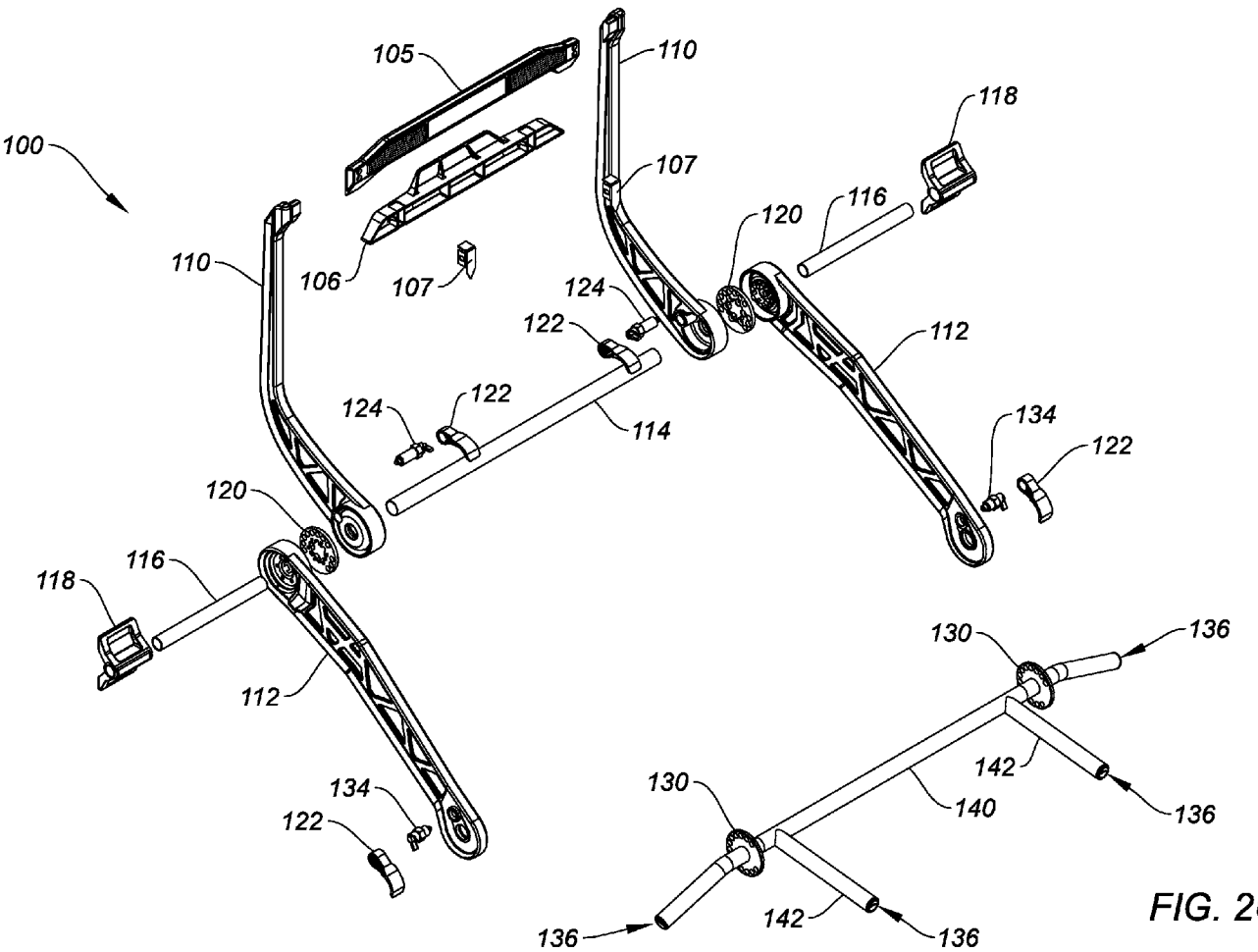
FIG. 26 is an exploded-parts view of the device shown in FIG. 25.
Figure 27:
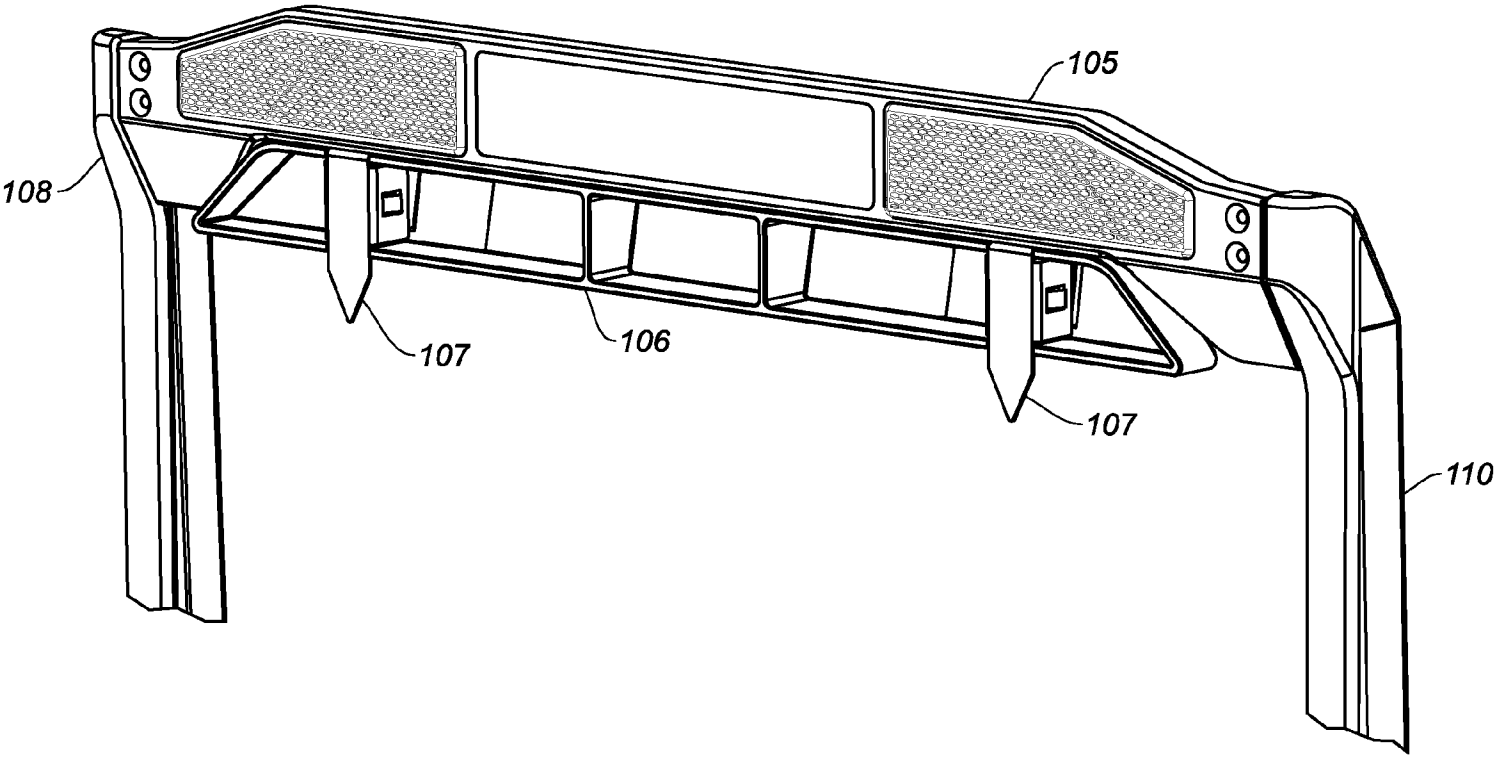
FIG. 27 is a partial, close-up view of the upper part of the device to illustrate a safety mechanism in more detail.
Figure 28:
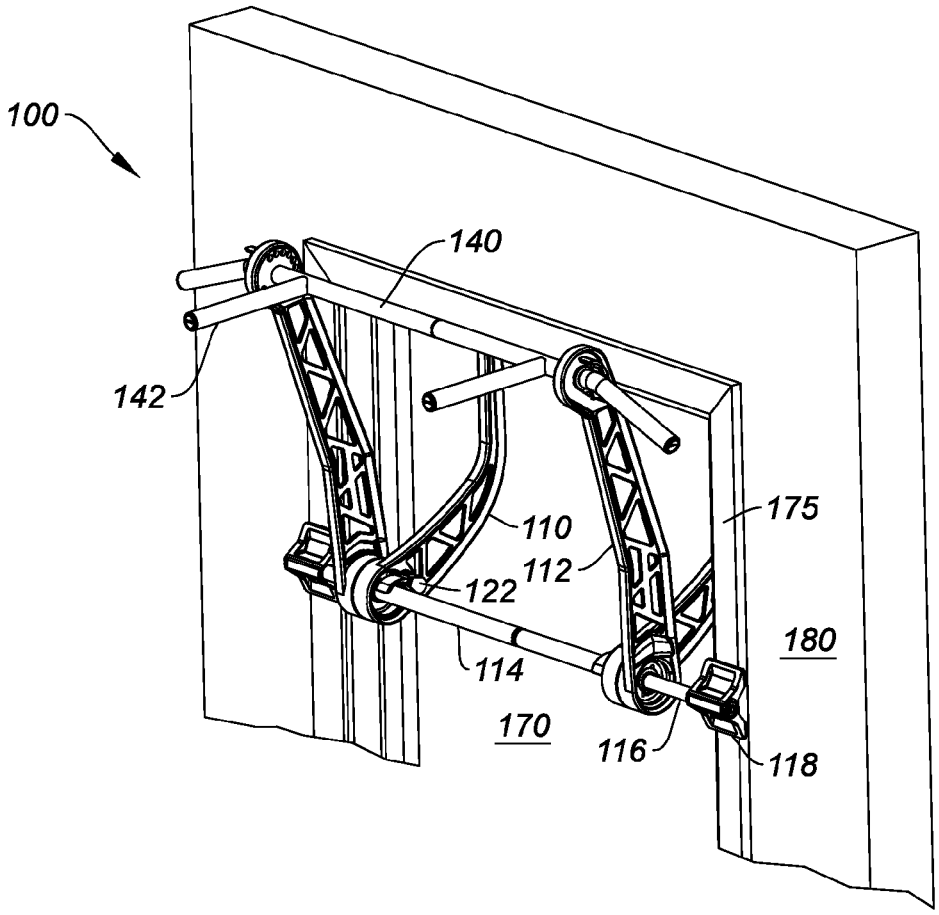
FIG. 28 is a perspective view of the device of FIG. 25 installed within a doorway against trim of a doorframe to illustrate a doorway-mounted configuration thereof.
Figure 29:
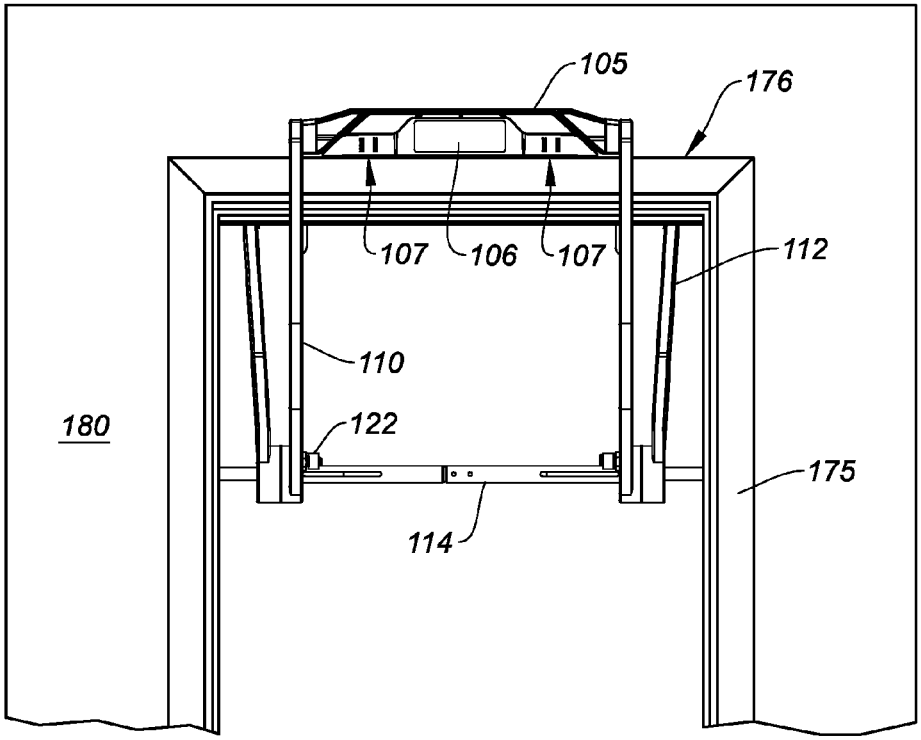
FIG. 29 is a rear view of the device of FIG. 25 installed on trim of the doorframe within the doorway.

FIG. 25 is a perspective view of an exercise device according to another example embodiment; FIG. 26 is an exploded-parts view of the device shown in FIG. 25; FIG. 27 is a partial, close-up view of the upper part of the device to illustrate a safety mechanism in more detail; FIG. 28 is a perspective view of the device of FIG. 25 installed within a doorway against trim of a doorframe to illustrate a doorway-mounted configuration thereof; and FIG. 29 is a rear view of the device of FIG. 25 installed on trim of the doorframe within the doorway.

Referring to FIGS. 25-29, there is shown an exercise device 100 which includes a generally elongate, tubular or solid, metal/steel or hard-plastic horizontal bar 105 configured for engagement with doorframe 175 trim extending along a rear facing of a wall 180 above a doorway 170, a pair of tubular or solid, metal support arms 110 in parallel, spaced relation to one another. Each support arm 110 has its upper end attached to an end of the horizontal bar 105 and its lower, disc-shaped end extending through the doorway 170. A generally tubular-shaped, hollow or partially solid metal or hard plastic pivot bar 114 is connected between the lower ends of the support arms 110 in a horizontal plane.

Device 100 further includes a pair of tubular, metal (or hard-plastic) pivot arms 112 in parallel, spaced relation to one another. The pivot bar 114 is connected between the pivot arms 112 at first, disc-shaped ends thereof. As has been described heretofore in previous example embodiments, the pivot arms 112 are configured to be rotated about the pivot bar 114 at their first ends so as to be oriented and secured in a plurality of different angular positions relative to the support arms 110.

Device 100 further includes a pull-up bar 140 extending between second disc-shaped ends of the pivot arms 112. The pull-up bar includes and a pair of grip handles 142 in spaced, parallel relation to one another, each extending in a plane perpendicular to a longitudinal axis of the pull-up bar 140. As has been described heretofore in previous example embodiments, the pull-up bar 140 with its contiguous grip handles 142 is configured to be rotated about the pivot arms 112 at their second ends, so as to be oriented and secured in a plurality of different angular positions relative to the pivot arms 112.

Referring to FIGS. 26, 27 and 29, the exercise device 100 may be configured to include a safety mechanism. The safety mechanism may comprise a door clip block 106 which may be secured to a surface of the horizontal bar 105. The door clip block 106 includes a pair of spaced, planar metal clips 107. The safety mechanism is such that the device 100 cannot be mounted in the doorway/to doorframe trim if the door clip block 106 is not installed. There is a ramp feature 108 on each support arm 110 where the horizontal bar 105 meets the support arms 110, thus keeping the device 100 from being secured in the doorway. Due to this ramp feature 108, the device 100 will not be able to be mounted to the doorframe 175 (i.e., will not sit on the doorframe 175 trim), unless the door clip block 106 is first mounted. As best shown in FIG. 29, and when the clip block 106 is attached to the horizontal bar 105 of device 100 is to be engaged with a top surface 176 of horizontal doorframe 175 trim extending along a rear facing wall 180 directly above the doorway 170, the clips 107 of clip block 106 are inserted in between the trim and the wall 180 surface. When device 100 is removed from the doorframe 175, the clip block 106 remains mounted to the doorframe 175 trim.

Similar to previous example embodiments, device 100 includes a pair of telescoping bar portions 116, each of which may be embodied as a tubular section of pipe made of steel and of sufficient length and outer diameter so that a distal end thereof fits into a horizontal aperture or bore through a doorframe pad 118, and a proximal end thereof fits into the pivot bar 114 so as to meet its opposite telescoping bar portion 116 at the half-way point of the pivot bar 114.

As best shown in FIG. 26, the lower disc-shaped ends of the support arms 110 and first disc-shaped ends of the pivot arms 112 are engagable by a lever arm 122 which actuates an entspannt part (hereafter referred to as a cam action indexing plunger, or "plunger 124"). As will be described in more detail hereafter, actuation of the lever arms 122 in one direction or the other will cause a pin 133 at the end of each plunger 124 to either (a) extend into one of the equally-spaced holes formed around the periphery of a metal or hard-plastic pin plate 120 provided between the lower disc-shaped ends of the support arms 110 and first disc-shaped ends of the pivot arms 112, so as to lock the pivot arms 112 in a desired angular position for exercise relative to the support arms 110; or (b) retract out of the hole in pin plate 120 so as to disengage the pivot arms 112 from the support arms 110, thereby enabling free rotation of the pivot arms 112 about the axis of the pivot bar 114 to another desired angular position for exercise.

The above operations are similar for orienting the grip handles 142 on pull-up bar 140 in a variety of different angular positions relative to the second, disc-shaped ends of the pivot arms 112. Here, lever arms 122 actuate slightly shorter cam action indexing plungers 134 so that pins 133 thereof extend into or retract out of one of the holes in corresponding fixed, pin plates 130 that are welded to pull-up bar 140, so as to either lock the pull-up bar 140 in a desired angular position or to disengage to permit the pull-up bar 140 to freely rotate (through central apertures in the pivot arm 112 second ends) about the pivot arms 112.

Figure 31:
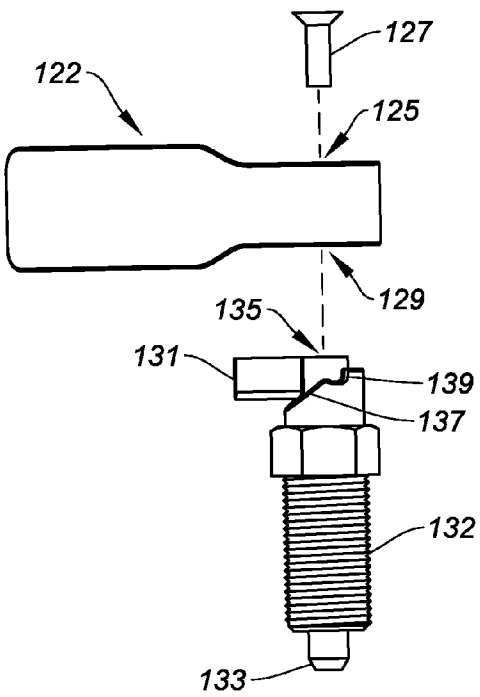
FIG. 31 is a side, exploded parts view to assist in explaining the cooperative relationship between the lever arms and plungers.
Figure 30:
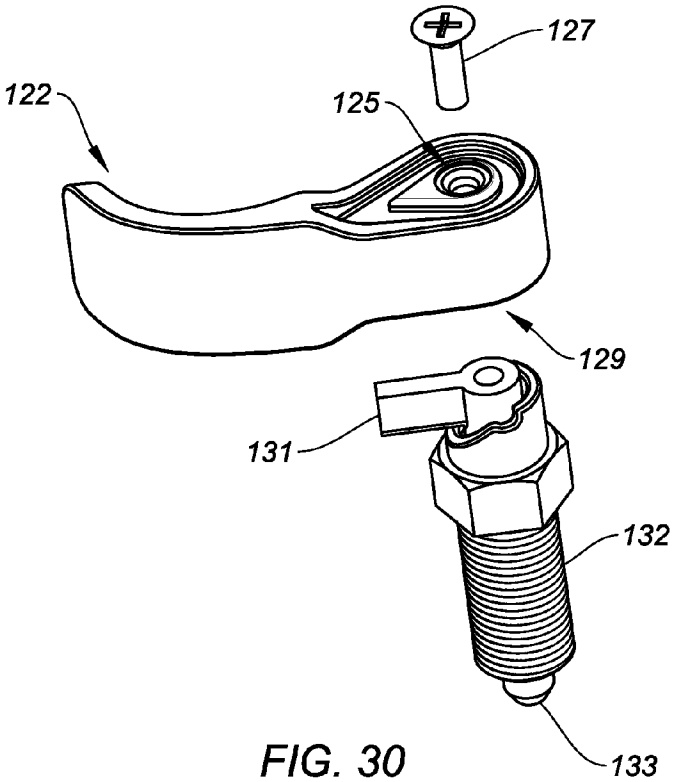
FIG. 30 is a perspective, exploded parts view to assist in explaining the cooperative relationship between the lever arms and plungers.

FIGS. 30 and 31 are perspective and side views to assist in explaining the cooperative relationship between the lever arms 122 and plungers 124/134. Each plunger 124/134 comprises a mini-lever 131 that is attached to pin 133 within a threaded collar 132. The threaded collar 132 feeds into a corresponding threaded bore in the side facing of the support arm 110 lower end, thereby securing the lever arm 122 with plunger 124 to the support arm 110. In similar fashion, the outside facing in the second disc-shaped end of the pivot arm 112 includes a threaded bore therein to receive the threaded collar 132 of the shorter plunger 134. The mini-lever 131 fits up within a cavity 129 (not shown) formed into the bottom surface of the lever arm 122. A fastener (screw 127) secures the plunger 124/134 to the lever arm 122 via bore 125 in lever arm 122 and a small threaded bore 135 formed in the top of the plunger 124/134.

Each plunger 124/134 further includes a ramp 137 and a lockout feature 139. The ramp 137 aids in disengaging the pin 133 from the pin plate 120/130 to allow pivot arm 112/pull-up bar 140 angle adjustment. To disengage the pin 133, the user would rotate the lever arm 122 up 180 degrees until the lever arm 112 rests in a lockout mode within lockout feature 139. The user can then adjust the pivot arms 112/pull-up bar 140 to the angle they desire. To lock the pivot arms 112/pull-up bar 140 in place, the user would rotate the lever arms 122 downward to a resting position; the user should hear a click sound from the left and right side of device 100 to confirm the pins 133 are engaged into their respective holes in pin plates 120/130.

Figure 32:
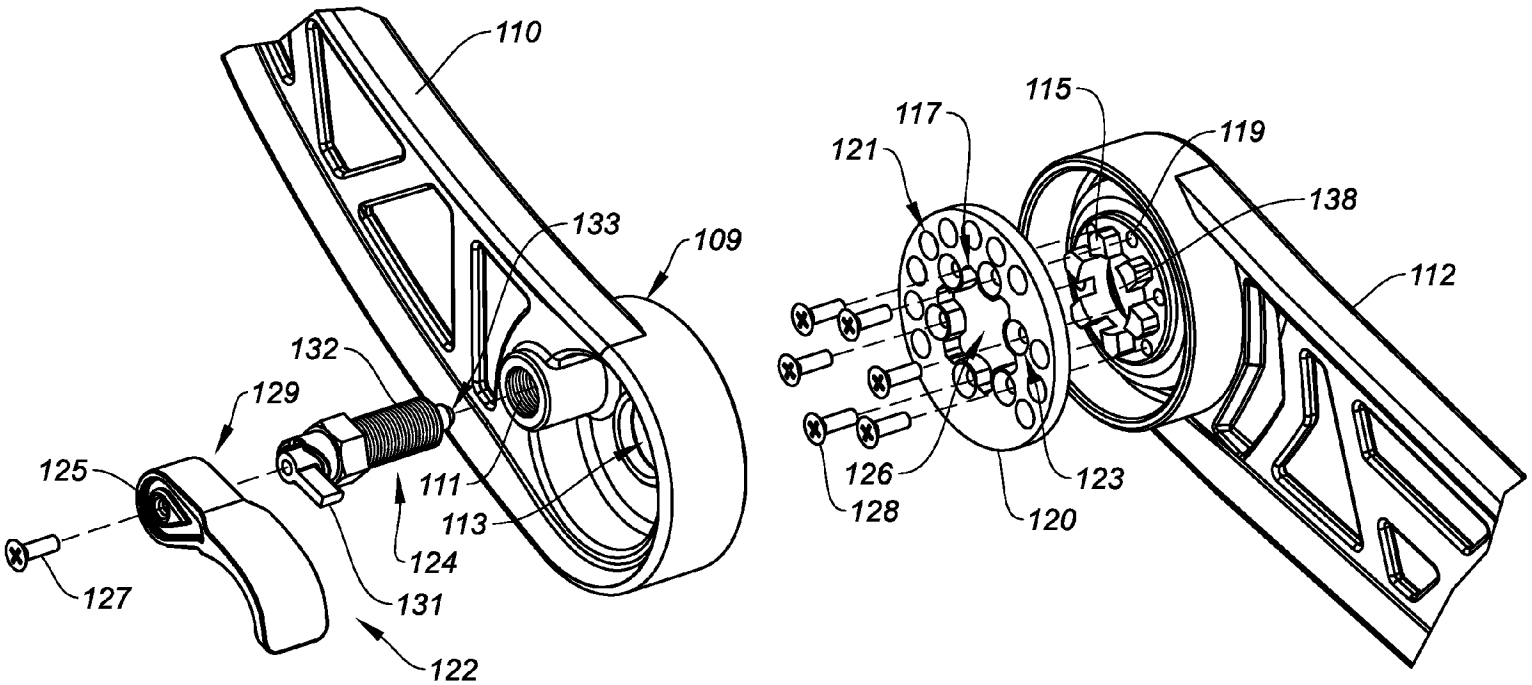
FIG. 32 is an exploded parts view of an enlarged section of the exercise device of FIG. 25 at the support arm/pivot arm interface.
Figure 33:
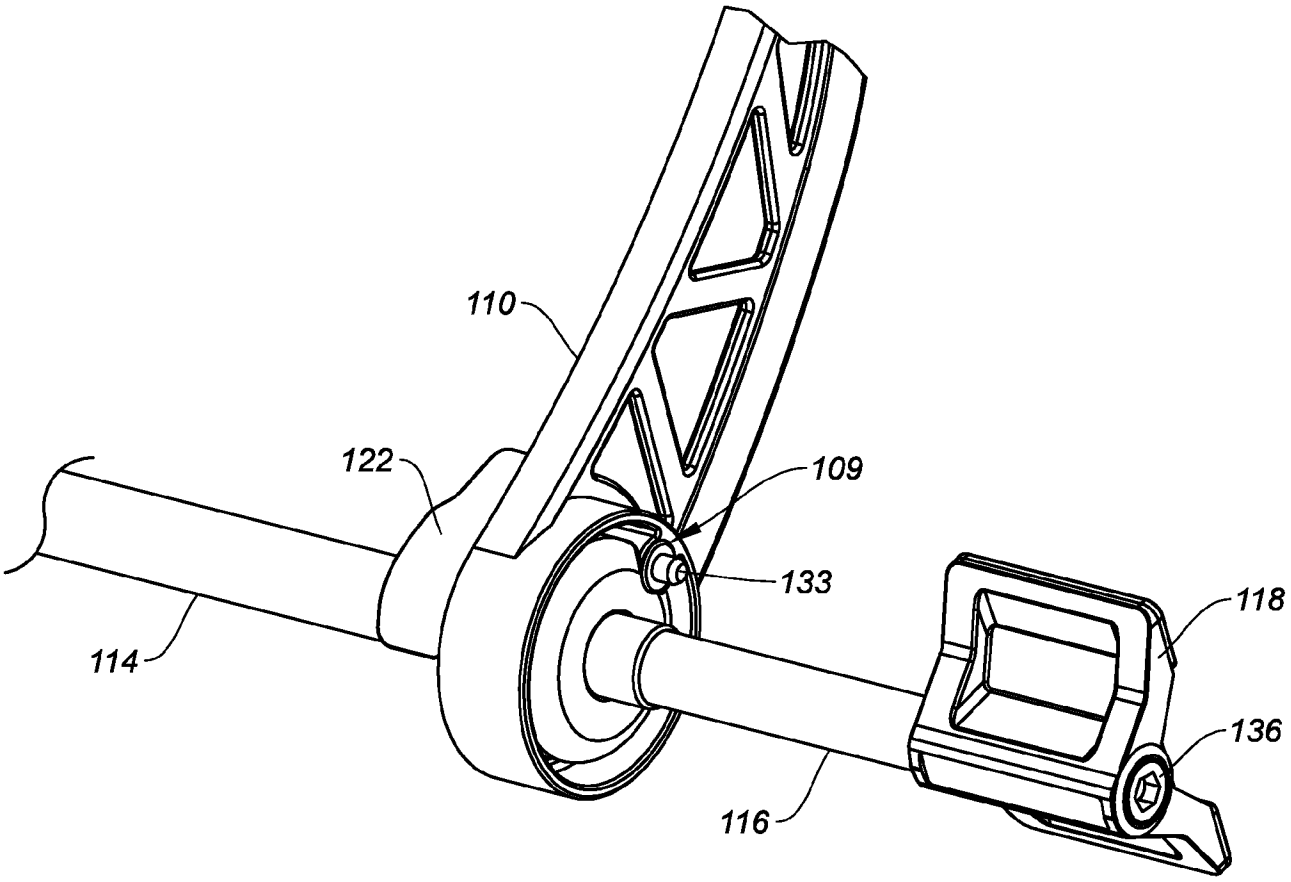
FIG. 33 is a perspective, enlarged view of a lower end of a support arm.

FIG. 32 is an exploded parts view of an enlarged section of device 1 at the support arm 110/pivot arm 112 interface to further describe the cooperative relationships between the lever arms 122, plungers 124, support arms 110 and pivot arms 112 in order to lock the pivot arms 112 in a desired angular position relative to the supports arms 110, or to disengage the pins 133 from the pin plates 120 to permit free rotation of the pivot arms 112. FIG. 33 is a perspective, enlarged view of a lower end of a support arm 110. In FIG. 33 the pin plate 120 and pivot arm 112 has been removed in order to illustrate the aperture 109 in the rear side facing of support arm 110 through which the pin 133 extends.

Referring to FIGS. 32 and 33, the threaded collar 132 of the plunger 124 is secured within the threaded bore 111 formed in the side facing of support arm 110. The pin is extensible into and retractable out of the aperture 109 in order to engage a hole 121 in pin plate 120. The pin plate 120 is secured to the pivot arm 112 via a plurality of fasteners 128 engaging corresponding threaded bores 119 (via interior holes 123 of pin plate 120) within the disc-shaped first end of the pivot arm 112. Additionally, the pivot arm 112 includes a plurality of finger supports 115 that engage notches 117 of the central aperture 126 in pin plate 120.

Figure 34:
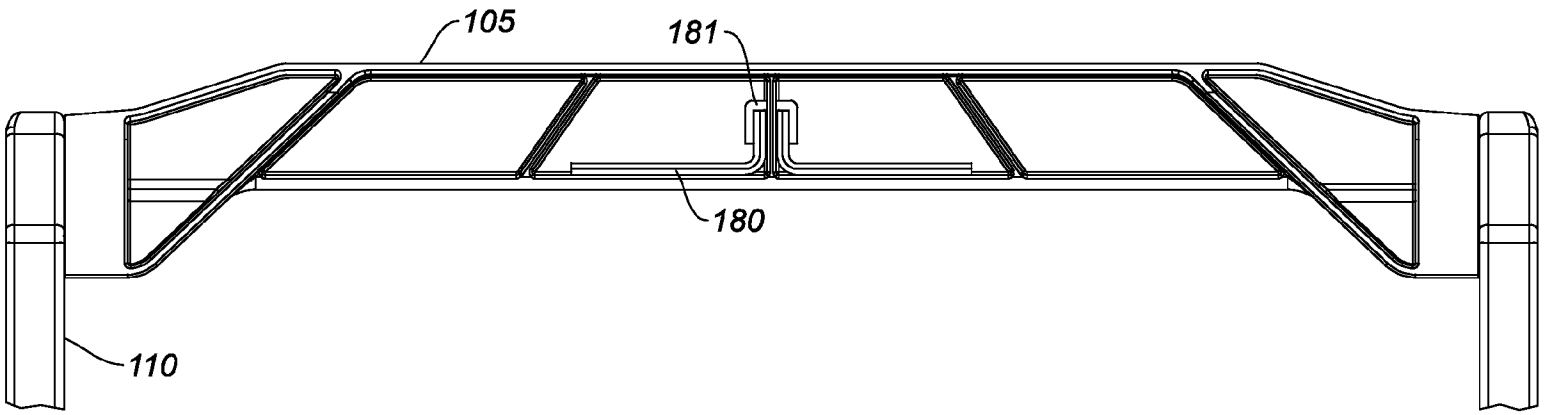
FIG. 34 illustrates a rear view of a top portion of the device 100 to illustrate a tool storage feature.

FIG. 34 illustrates a rear view of a top portion of the device 100 to illustrate a tool storage feature. In FIG. 34, the clip block 106 and clips 107 have been removed for purposes of clarity. As shown, a plurality of tools 190 may be stored in the rear cavity of horizontal bar 105. Bar 105 may include a plurality of clips 191 attached thereto as shown in FIG. 34 to secure tools 190 therein.

According to the example embodiments, the exercise devices described herein permit, but are not limited to, the following potential benefits and advantages: performance of a wide variety of exercises, including but not limited to pull-ups, chin-ups, rows, dips, push-ups, leg-raises, knee-raises, sit-ups, and crunches; performance of proprietary exercises such as ice pick pull-ups, rocking push-ups, and rocking dips; performance of assisted versions of some of the above exercises; adjustment of the pivot arm 44/112 positions and thus the height above ground from which exercises can be performed; adjustment of the grip assembly 50/pull-up bar 140 position and thus the angle of the grip handles 56/142; mounting of the device 1/100 in a doorway, including doorways with sills taller than the standard 6.35 cm; adjustment of the telescoping bar portions 38/116 to accommodate doorways of varying widths; use of the exercise device 1/100 in a multiple ground configurations (stable or rocking floor arrangement); mounting of the device 1 on a wall; collapsing of the exercise device 1 into two compact closed positions for convenient transport and storage.

In a variant, numerous accessories (alternatively referred to as peripherals) may be provided for attachment to the exercise device, including, but not limited to: back pad attachable to the grip assembly 50/pull-up bar 140—a pad for the user to rest his/her back against while performing leg/knee raises; elbow pads attachable to the grip handles 56/142—pads for the user to rest his/her elbows and forearms against while performing leg/knee raises; exercise straps attachable to various components of the exercise device and used for performing various exercises; resistance bands attachable to the exercise device to complete exercises or assist in pull-ups and dips; climbing board supported by the grip assembly 50—a vertical board attaching climbing grips; grip accessories attachable to the grip assembly 50/handles 56/142—thicker grip attachments.

Example embodiments are constructed with the majority of the primary components and assemblies held together using removable screws, clamps, and collars. Such means of construction allows for ease of assembly and disassembly of the device. Therefore, the device may be shipped to the consumer disassembled, requiring smaller packaging, and thus incurring reduced shipping fees compared to a unit shipped assembled. In alternative constructions, certain components may be permanently affixed to one another.

Additionally, the example embodiments described herein may be used to perform additional exercises not noted above, including but not limited to: physical therapy; stretching; a mount for various exercise accessories including straps, bands, rings, and climbing accessories; a mount for a work surface; a mount for attaching game boards; a place to hang a wide variety of objects including bicycles, tools, punching bags, a swing, a chair, and the like.

The example embodiments being thus described, it will be obvious that the same may be varied in many ways. Such variations are not to be regarded as departure from the example embodiments, and all such modifications as would be obvious to one skilled in the art are intended to be included within the following claims.

We claim:

1. An exercise device configured to be secured within a doorway for performing exercises and configured for use on a ground surface to perform exercises, the device comprising:

an elongate, horizontal bar configured for engagement with a top surface of a horizontal doorframe trim extending along a rear facing wall directly above the doorway, a pair of support arms in parallel spaced relation to one other, each support arm having a first end attached to a respective end of the horizontal bar and extending downward therefrom so that second ends of the support arms extend forward of the horizontal bar through the doorway, an elongate pivot bar extending through apertures in the second ends of the support arms so as to be perpendicular to the support arms, the pivot bar having a telescoping bar portion inserted in each end thereof which is retractable into and extensible out of its respective pivot bar end, each telescoping bar portion engageable with front-facing, vertical door trim on each side of the doorway to assist in securing the exercise device in the doorway with the horizontal bar, a pair of pivot arms in parallel spaced relation to one other and having first ends with apertures therein through which the pivot bar extends in perpendicular relation thereto, a first end of each pivot arm adjacent a corresponding second end of a support arm on the pivot bar, the pivot arms configured to be rotated about a longitudinal axis of the pivot bar at their first ends so as to be oriented and secured in a plurality of different angular positions relative to the support arms, and each pivot arm terminating in a second end having an aperture therein through which an elongate pull-up bar extends between in perpendicular relation thereto.

2. The device of claim 1, wherein the pull-up bar includes a pair of grip handles spaced from one another thereon, the grip handles extending in a plane perpendicular to a longitudinal axis of the pull-up bar.

3. The device of claim 2, wherein the pull-up bar is configured to be rotatable within the apertures at the second ends of the pivot arms so that the grip handles thereon can be oriented and secured in a plurality of different angular positions relative to the pivot arms.

4. The device of claim 1, wherein the device is configured to be removed from the doorway and placed on a ground surface to perform exercises thereon in a first ground configuration and in a second ground configuration.

5. The device of claim 4, wherein, with the exercise device in the first ground configuration, the horizontal bar, second ends of the supports arms, and adjacent first ends of the pivot arms serve as contact points with the ground surface.

6. The device of claim 5, wherein the support arms having a generally curvilinear shape and extend generally parallel to the ground surface so that curved portions thereof do not contact the ground surface, and the pivot arms are secured in an angular position relative to the support arms so as to extend generally upward from their first ends at the ground surface, their second ends supporting the pull-up bar above the ground surface.

7. The device of claim 4, wherein, with the exercise device in the second ground configuration, the support arms having a generally curvilinear shape, only the curved portions at approximate midpoints thereof, which extend generally parallel to the ground surface, contact the ground surface between the horizontal bar and the pivot bar so that exercise with an instability introduced is possible with the device.

8. The device of claim 7, wherein the pivot arms are secured in an angular position relative to the support arms so as to extend generally upward from their first ends and away from the ground surface, their second ends supporting the pull-up bar above the ground surface.

9. The device of claim 1, wherein a distal end of each telescoping bar portion terminates in a stop member having a planar, flat face for a flush engagement with the front-facing, vertical door trim on each side of the doorway.

10. The device of claim 1, wherein the horizontal bar further includes a cavity therein for storing tools.

11. An exercise device, comprising:

an elongate, horizontal bar configured for engagement with a doorframe trim extending along a rear facing wall above a doorway, a pair of elongate support arms, each having one end attached to the horizontal bar and extending downward therefrom to its lower end, an elongate pivot bar connected between the support arms, the pivot bar including a telescoping bar portion inserted into each end thereof which is retractable into and extensible out of its respective pivot bar end, each telescoping bar portion engageable with front-facing, vertical door trim on each side of the doorway to assist in securing the exercise device in the doorway with the horizontal bar, a pair of pivot arms, each pivot arm having one end through which an end of the pivot bar extends, the one end adjacent a corresponding lower end of a support arm, the pivot arms configured to be rotated about a longitudinal axis of the pivot bar at their one ends so as to be oriented and secured in a plurality of different angular positions relative to the support arms, and an elongate pull-up bar extending between the other ends of the pivot arms.

12. The device of claim 11, wherein each one end of the pivot arm and adjacent lower end of a support arm include an aperture in alignment with the other, the device further comprising:

a circular pin plate provided between each one end of the pivot arm and adjacent support arm lower end, the pin plate including a central aperture aligned with the apertures in the pivot arm and the support arm, and a plurality of adjacent pin holes formed along a periphery thereof, a first pair of lever arms, each lever arm of the first pair configured to be user-rotated in a first direction to disengage a pin connected thereto from one of the pin holes in a corresponding pin plate in order to rotate its pivot arm into another angular position relative to its corresponding support arm, and thereafter to be rotated in a second direction to engage the pin in the pin plate so as to lock the pivot arm in place in its new angular position.

13. The device of claim 11, wherein the pull-up bar includes a pair of tubular grip handles spaced from one another thereon, each grip handle extending in a plane perpendicular to a longitudinal axis of the pull-up bar, and the other ends of the pivot arms each include an aperture therein, the device further comprising:

a pair of circular pin plates fixed at opposite ends of the pull-up bar so as to be adjacent a corresponding other end of a pivot arm, each pin plate including a central aperture aligned with the aperture in the pivot arm other end, and a plurality of adjacent pin holes formed along a periphery thereof, a second pair of lever arms, each lever arm of the second pair configured to be user-rotated in a first direction to disengage a pin connected thereto from one of the pin holes in a corresponding pin plate in order to rotate the pull-up bar with grip handles into another angular position relative to its corresponding pivot arm, and thereafter to be rotated in a second direction to engage the pin in the pin plate so as to lock the pull-up bar with grip handles in place in its new angular position.

14. The device of claim 11, further comprising:

a door stop attached to each distal end of a corresponding telescoping bar portion, each door stop having a face with a door stop pad thereon that is engageable with a front-facing, vertical door trim on each side of the doorway to assist in securing the exercise device in the doorway with the horizontal bar.

15. The device of claim 11, wherein the device is configured to be removed from the doorway and placed on a ground surface to perform exercises thereon in a first ground configuration and in a second ground configuration.

16. The device of claim 15, wherein, with the exercise device in the first ground configuration, the horizontal bar, lower ends of the supports arms, and adjacent one ends of the pivot arms serve as contact points with the ground surface, the support arms extend generally parallel to the ground surface, and the pivot arms are secured in an angular position relative to the support arms so as to extend generally upward from their one ends at the ground surface, their other ends supporting the pull-up bar above the ground surface.

17. The device of claim 15, wherein, with the exercise device in the second ground configuration, only a portion of the support arms at approximate mid-points thereof, which extend generally parallel to the ground surface, contact the ground surface between the horizontal bar and pivot bar so that exercise with an instability introduced is possible with the device, and the pivot arms are secured in an angular position relative to the support arms so as to extend generally upward from their one ends and away from the ground surface, their other ends supporting the pull-up bar above the ground surface.

18. An exercise device, comprising:

a horizontal bar configured for engagement with a door-frame trim extending along a rear facing wall above a doorway, a pair of support arms, each having one end attached to the horizontal bar and the other end extending through the doorway, a pivot bar connected between the support arms, a pair of pivot arms, the pivot bar also connected between the pivot arms at first ends thereof, the pivot arms configured to be rotated about a longitudinal axis of the pivot bar at their first ends so as to be oriented and secured in a plurality of different angular positions relative to the support arms, and a pull-up bar extending between second ends of the pivot arms and including grip handles thereon, the pull-up bar configured to be rotated about the pivot arms at their second ends so that the handle grips are oriented and secured in a plurality of different angular positions relative to the pivot arms.

* * * * *